US011084291B2

(12) United States Patent
Koganehira et al.

(10) Patent No.: US 11,084,291 B2
(45) Date of Patent: Aug. 10, 2021

(54) LIQUID CONSUMPTION APPARATUS AND CONTROL METHOD OF LIQUID CONSUMPTION APPARATUS

(71) Applicant: SEIKO EPSON CORPORATION, Tokyo (JP)

(72) Inventors: Shuichi Koganehira, Matsumoto (JP); Noriyuki Inukai, Matsumoto (JP); Shigeki Fukushima, Matsumoto (JP); Yasuhiko Kosugi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/815,899

(22) Filed: Mar. 11, 2020

(65) Prior Publication Data

US 2020/0290360 A1 Sep. 17, 2020

(30) Foreign Application Priority Data

Mar. 12, 2019 (JP) ..... JP2019-044446

(51) Int. Cl.
*B41J 2/175* (2006.01)

(52) U.S. Cl.
CPC ..... *B41J 2/175* (2013.01); *B41J 2/1752* (2013.01); *B41J 2/17543* (2013.01); *B41J 2/17546* (2013.01); *B41J 2/17566* (2013.01)

(58) Field of Classification Search
CPC ..... B41J 2/175; B41J 2/1752; B41J 2/17543; B41J 2/17546; B41J 2/17566
See application file for complete search history.

(56) References Cited

U.S. PATENT DOCUMENTS

2004/0246284 A1* 12/2004 Murai ..... B41J 25/308 347/8
2015/0091976 A1* 4/2015 Mizutani ..... B41J 2/16523 347/23
2016/0294670 A1* 10/2016 Pacella ..... H04L 45/70

FOREIGN PATENT DOCUMENTS

JP 2004-098365 A 4/2004

* cited by examiner

*Primary Examiner* — Anh T Vo
(74) *Attorney, Agent, or Firm* — Oliff PLC

(57) ABSTRACT

A control unit of a liquid consumption apparatus performs determination processing that determines whether or not each of a first housing container and a second housing container is an unsuitable container that does not satisfy a use condition, performs switching decision that decides switching of a supply source that supplies a liquid composition to a liquid consumption unit to the second housing container when the first housing container is determined to be the unsuitable container while the liquid composition is being supplied from the first housing container to the liquid consumption unit, and continues supply of the liquid composition from the first housing container to the liquid consumption unit regardless of whether or not the second housing container is the unsuitable container until when the switching decision is performed while the liquid composition is being supplied from the first housing container to the liquid consumption unit.

11 Claims, 14 Drawing Sheets

LIQUID CONSUMPTION APPARATUS AND CONTROL METHOD OF LIQUID CONSUMPTION APPARATUS

The present application is based on, and claims priority from JP Application Serial Number 2019-044446, filed Mar. 12, 2019, the disclosure of which is hereby incorporated by reference herein in its entirety.

BACKGROUND

1. Technical Field

The present disclosure relates to a liquid consumption apparatus.

2. Related Art

As an example of the liquid consumption apparatus, an ink jet printer that performs printing by discharging ink, which is an example of a liquid composition, to a print medium is known. JP-A-2004-98365 discloses an ink jet printer which is mounted with two cartridges as ink housing containers that house the same color ink and which switches an ink supply source to a second cartridge when an ink remaining amount of a first cartridge becomes small.

An ink jet printer may be mounted with an unsuitable cartridge that does not satisfy a predetermined use condition, such as, for example, a cartridge whose ink remaining amount has already been less than a defined amount and an unspecified cartridge that is not assumed to be used. It is desirable that an appropriate countermeasure is taken so that such an unsuitable cartridge is prevented from being mounted or used.

However, in the technique of JP-A-2004-98365, such an unsuitable cartridge is not particularly considered. Therefore, in JP-A-2004-98365, even if the second cartridge is an unsuitable cartridge, when the ink remaining amount of the first cartridge becomes less than a defined amount, the second cartridge may be automatically switched to the ink supply source and used.

While it is desired to restrain use of unsuitable cartridge as described above, if mounting and use of unsuitable cartridge are strictly detected and printing is interrupted for every detection, the efficiency of print processing may be significantly degraded. Such a problem is not only a problem of an ink jet printer, but also a common problem for liquid consumption apparatuses that consume liquid while alternatively switching a supply source of a liquid composition between two or more housing containers.

SUMMARY

A form of a technique of the present disclosure is provided as a liquid consumption apparatus that receives supply of a liquid composition from a first housing container or a second housing container that houses the liquid composition. The liquid consumption apparatus of this form includes a liquid consumption unit that consumes the liquid composition, a holder having a first mounting port where the first housing container is detachably mounted and a second mounting port where the second housing container is detachably mounted, a switching mechanism that switches a supply source of the liquid composition for the liquid consumption unit to the first housing container or the second housing container, and a control unit that controls operation of the switching mechanism. The control unit performs determination processing that determines whether or not each of the first housing container and the second housing container is an unsuitable container that does not satisfy a predetermined use condition in a period from when the housing container is mounted in the holder to when the housing container is removed from the holder. The control unit performs switching decision that decides switching of the supply source to the second housing container when the first housing container is determined to be the unsuitable container while the liquid composition is being supplied from the first housing container to the liquid consumption unit. The control unit continues supply of the liquid composition from the first housing container to the liquid consumption unit regardless of whether or not the second housing container is the unsuitable container until when the switching decision is performed while the liquid composition is being supplied from the first housing container to the liquid consumption unit.

DESCRIPTION OF EXEMPLARY EMBODIMENTS

1. Embodiment

1-1 Configuration of Liquid Consumption Apparatus

Figure 1:
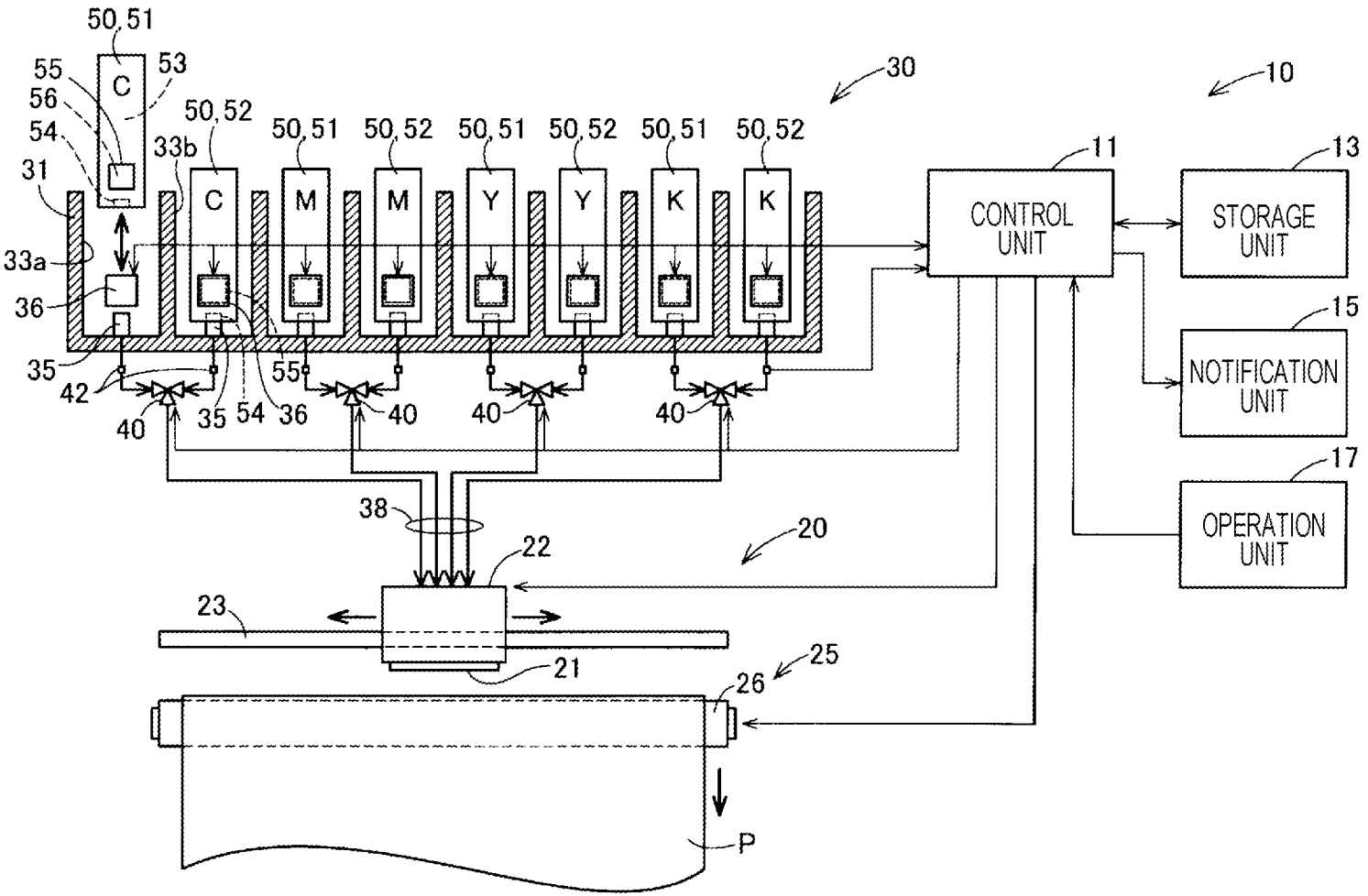
FIG. 1 is a schematic diagram showing a configuration of a liquid consumption apparatus.

FIG. 1 is a schematic diagram showing a configuration of a liquid consumption apparatus 10 according to an embodiment. In the present embodiment, the liquid consumption apparatus 10 is an ink jet printer, which discharges ink that is an example of a liquid composition and records ink dots on a medium P. The medium P is, for example, a printing paper. The liquid consumption apparatus 10 includes a control unit 11, a storage unit 13, a notification unit 15, an operation unit 17, a liquid consumption unit 20, and a liquid supply unit 30.

The control unit 11 controls operation of the liquid consumption apparatus 10. The control unit 11 is composed of a computer including at least one processor and a main storage unit. The processor reads a program and commands into the main storage unit end executes them, so that the control unit 11 exhibits various functions to control the liquid consumption apparatus 10. Some of the functions of the control unit 11 may be realized by a hardware circuit.

The storage unit 13 stores various control information, which the control unit 11 uses for control of the liquid consumption apparatus 10, in a non-volatile manner under control of the control unit 11. Specific examples of the control information stored in the storage unit 13 will be described later. The notification unit 15 notifies a message for a user, status information indicating a current state of the liquid consumption apparatus 10, and the like under control of the control unit 11. The notification unit 15 is composed of, for example, a liquid crystal panel. Notification contents from the notification unit 15 will be described later. The operation unit 17 receives an operation from a user and outputs content of the operation to the control unit 11. The operation unit 17 is composed of, for example, buttons and switches provided on a housing of the liquid consumption apparatus 10. The operation unit 17 may be composed of an operation device such as a keyboard of a computer coupled to the liquid consumption apparatus 10.

In the liquid consumption apparatus 10, ink supplied from the liquid supply unit 30 is consumed by print processing performed by the liquid consumption unit 20. The liquid consumption unit 20 includes a print head 21, a carriage 22 mounted with the print head 21, and a medium transport unit 25. The print head 21 includes a plurality of nozzles and discharges ink from the nozzles under control of the control unit 11. Although not shown in the figures and detailed description is omitted, in the print head 21, the plurality of nozzles form nozzle arrays for each color ink described later. The discharge of ink from the nozzles of the print head 21 is performed by a known method such as, for example, applying pressure to the ink by piezo elements.

The carriage 22 is attached to a drive shaft 23 disposed in a direction crossing a transport direction of the medium P above the transport direction of the medium P. The carriage 22 is reciprocated along the drive shaft 23 by a driving force of a motor transmitted through a pulley and an endless belt not shown in the figures under control of the control unit 11.

The medium transport unit 25 includes a drive roller 26 that is rotated by a driving force of a motor not shown in the figures and transports the medium P by rotating the drive roller 26 under control of the control unit 11. In the print processing, the control unit 11 forms an image on the medium P by discharging ink from the print head 21 to the medium P while transporting the medium P to the medium transport unit 25 and moving the carriage 22 according to print data.

The liquid supply unit 30 supplies ink housed in a plurality of housing containers 50 exchangeably mounted on the liquid supply unit 30 to the liquid consumption unit 20. First, a configuration of the housing container 50 mounted on the liquid supply unit 30 will be described. In the present embodiment, the housing container 50 is configured as a so-called cartridge. Hereinafter, the housing container 50 is also referred to as a "container 50".

In the liquid supply unit 30, two containers 51 and 52 are mounted for each of a plurality of color inks. FIG. 1 shows an example of a configuration where two containers 51 and 52 are mounted for each of four color inks, cyan (C), magenta (M), yellow (Y), and black (K). The alphabet characters C, M, Y, and K attached to the containers 50 in FIG. 1 represent the kinds of colors mentioned above. The kinds of color inks are not limited to the four colors C, M, Y, and K. The containers 50 may house ink of, for example, light cyan, light magenta, or the other special color in addition to the color inks described above or instead of one of the color inks described above. The number of kinds of color inks may be less than four, and for example, only black ink may be used. In the liquid consumption apparatus 10, first, ink is supplied from a first container 51 to the liquid consumption unit 20, and when a remaining amount of the ink in the first container 51 becomes less than a predetermined defined amount, a supply source of ink to the liquid consumption unit 20 is switched to a second container 52. The details of control of switching the supply source of ink will be described later.

Each container 50 includes a housing section 53 where ink is housed, a supply port 54 that lets the ink in the housing section 53 flow out to the outside, and a substrate section 55 electrically coupled to the liquid consumption apparatus 10. The substrate section 55 has a container side storage unit 56 where information can be written and stored in a non-volatile manner on its back side. The container side storage unit 56 stores container information that is information related to the container 50. The container information will be described later.

The liquid supply unit 30 includes holders 31 where each container 50 is detachably mounted. The holder 31 has a first mounting port 33*a* where the first container 51 is mounted and a second mounting port 33*b* where the second container 52 is mounted. Each of bottom surfaces of the mounting ports 33*a* and 33*b* is provided with an ink receiving section 35 coupled to the supply port 54 of each of the containers 51 and 52. Further, each of the mounting ports 33*a* and 33*b* is provided with an electrical coupling section 36 that is electrically coupled to the substrate section 55 of each of the containers 51 and 52 when each of the containers 51 and 52 is coupled. The electrical coupling section 36 is electrically coupled to the control unit 11 and mediates communication between the substrate section 55 and the control unit 11. The control unit 11 detects that the housing container 50 is mounted into the holder 31 when detecting an electrical contact between the electrical coupling section 36 and the substrate section 55 of the container 50. Although not shown in the figures, a lever is provided to each of the mounting ports 33*a* and 33*b*. The lever engages with a part of the container 50 and prevents the container 50 from falling off from the holder 31 when the container 50 is mounted. The lever is configured to be able to lock the container 50 in a state in which the substrate section 55 and the electrical coupling section 36 are correctly coupled and the supply port 54 and the ink receiving section 35 are correctly coupled. A user can remove the container 50 from the holder 31 by releasing the engagement of the lever with the container 50 by rotating the lever in a direction away from the container 50 at an arbitrary timing.

The liquid supply unit 30 further includes a pipe 38 which couples each ink receiving section 35 with the print head 21 mounted on the carriage 22 and through which ink flows. The pipe 38 is provided with a switching mechanism 40 for switching the supply source of ink to the liquid consumption unit 20 to the first container 51 or the second container 52. The switching mechanism 40 is provided for each color ink, that is, for each pair of the first and second containers 51 and 52. The switching mechanism 40 is composed of a switching valve and has three ports coupled to the ink receiving section 35 of the first mounting port 33*a*, the ink receiving section 35 of the second mounting port 33*b*, and the liquid consumption unit 20, respectively. A switching operation performed by the switching mechanism 40 is controlled by the control unit 11.

A sensor mechanism 42 is provided in a section between the switching mechanism 40 on the pipe 38 and each ink receiving section 35. The sensor mechanism 42 physically detects pressure in an ink flow path in the pipe 38 and transmits its detection result to the control unit 11. The sensor mechanism 42 is composed of, for example, a pressure sensor. As described later, the control unit 11 detects a supply failure of ink from each container 50 by using the detection result of the sensor mechanism 42.

1-2. Information Used for Control of Liquid Consumption Apparatus

Figure 2A:
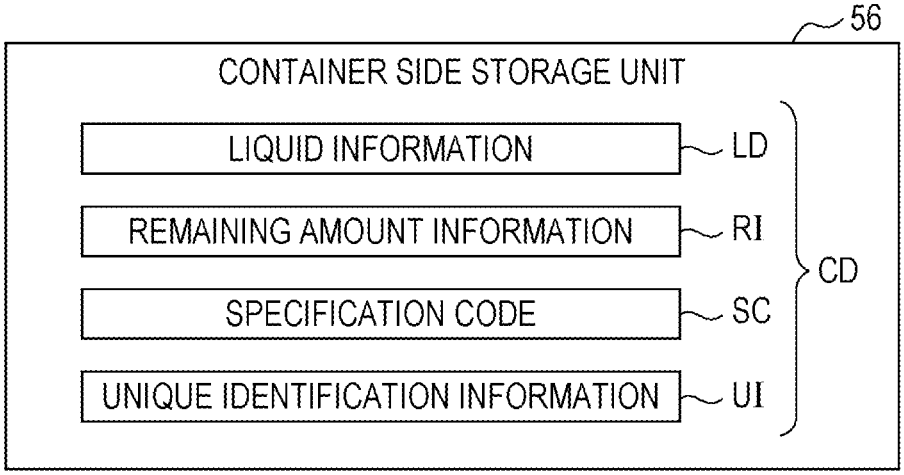
FIG. 2A is an explanatory diagram showing container information stored in a container side storage unit.

FIG. 2A is an explanatory diagram showing container information CD stored in the container side storage unit 56 of the housing container 50. The container information CD includes liquid information LD, remaining amount information RI, specification code SC, and unique identification information UI. The liquid information LD includes information of type, color, and the like of the ink housed the container 50. The remaining amount information RI indicates a housing amount of ink housed in the container 50. The specification code SC is identification information indicating that the container 50 satisfies a condition to be used in the liquid consumption apparatus 10. For example, the specification code SC is used to authenticate the container 50 in order to prevent a risk that a user uses an unspecified container 50 against intention of the user. The specification code SC is encrypted and stored in the container side storage unit 56. For the encryption of the specification code SC, a well-known common key encryption method such as, for example, DES (Data Encryption Standard) or AES (Advanced Encryption Standard) can be employed. The unique identification information UI is a unique code given to each individual body in order to identify each container 50.

Figure 2B:
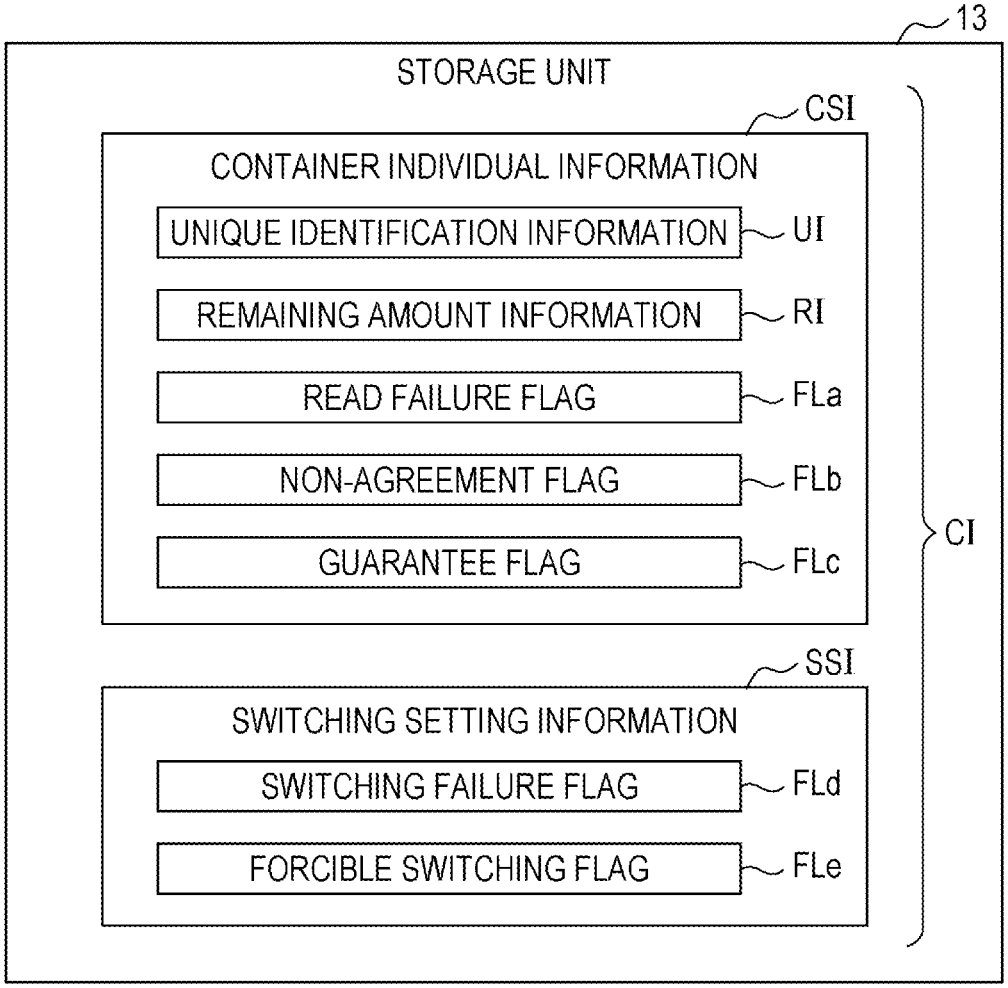
FIG. 2B is an explanatory diagram showing control information stored in a storage unit.

FIG. 2B is an explanatory diagram showing control information CI stored in the storage unit 13. The control information CI includes container individual information CSI that is individual information of each container 50 mounted in the holder 31 of the liquid supply unit 30 and switching setting information SSI used for switching control of the switching mechanism 40.

The container individual information CSI is stored in an address assigned in advance for each container 50. The container individual information CSI includes the unique identification information UI and the remaining amount information RI. When the container 50 is mounted in the holder 31, the control unit 11 reads the unique identification information UI and the remaining amount information RI from the container side storage unit 56 of the substrate section 55 and stores them in the storage unit 13. When ink is supplied from the container 50 to the liquid consumption unit 20, the remaining amount information RI is updated by the control unit 11. In this case, the control unit 11 also updates and overwrites the remaining amount information RI stored in the container side storage unit 56 of the container 50.

The container individual information CSI further includes various flags FLa, FLb, and FLc that are set by the control unit 11 while the liquid consumption apparatus 10 is being controlled. In the present specification, "set a flag" means "erect a flag" and means that a value of the flag is set from an initial value "0" to "1" indicating a state that the flag is erected. Each of the flags FLa, FLb, and FLc is set to an initial value before the container 50 is mounted in the holder 31.

The read failure flag FLa is a flag indicating whether or not the control unit 11 can read the container information CD from the container side storage unit 56. The read failure flag FLa is set when a state in which the container information CD cannot be normally read from the container side storage unit 56 is detected in a case where the container 50 is mounted in the holder 31. The non-agreement flag FLb is a flag indicating whether or not the container 50 is allowed to be used in the liquid consumption apparatus 10. The non-agreement flag FLb is set when the container 50 an unspecified container that is not allowed to be used in the liquid consumption apparatus 10. The guarantee flag FLc is a flag indicating the presence or absence of charged guarantee for the container 50. The guarantee flag FLc is set when it is detected that the container 50 is out of the scope of the charged guarantee.

The switching setting information SSI is control information for the switching mechanism 40 for each color ink and is stored in an address assigned in advance for each switching mechanism 40. The switching setting information SSI includes a switching failure flag FLd and a forcible switching flag FLe. The switching failure flag FLd is a flag indicating that switching that switches the supply source of ink to the liquid consumption unit 20 to the first container 51 or the second container 52 is cancelled. The switching failure flag FLd is set when the switching of the supply source of ink to the liquid consumption unit 20 is decided and thereafter the switching is cancelled. The forcible switching flag FLe is a flag indicating that a user allows forcible switching of the supply source of ink to the liquid consumption unit 20. The forcible switching flag FLe is set according to a setting operation performed by the user through the operation unit 17.

1-3. Notification Screen of Notification Unit

Figure 3:
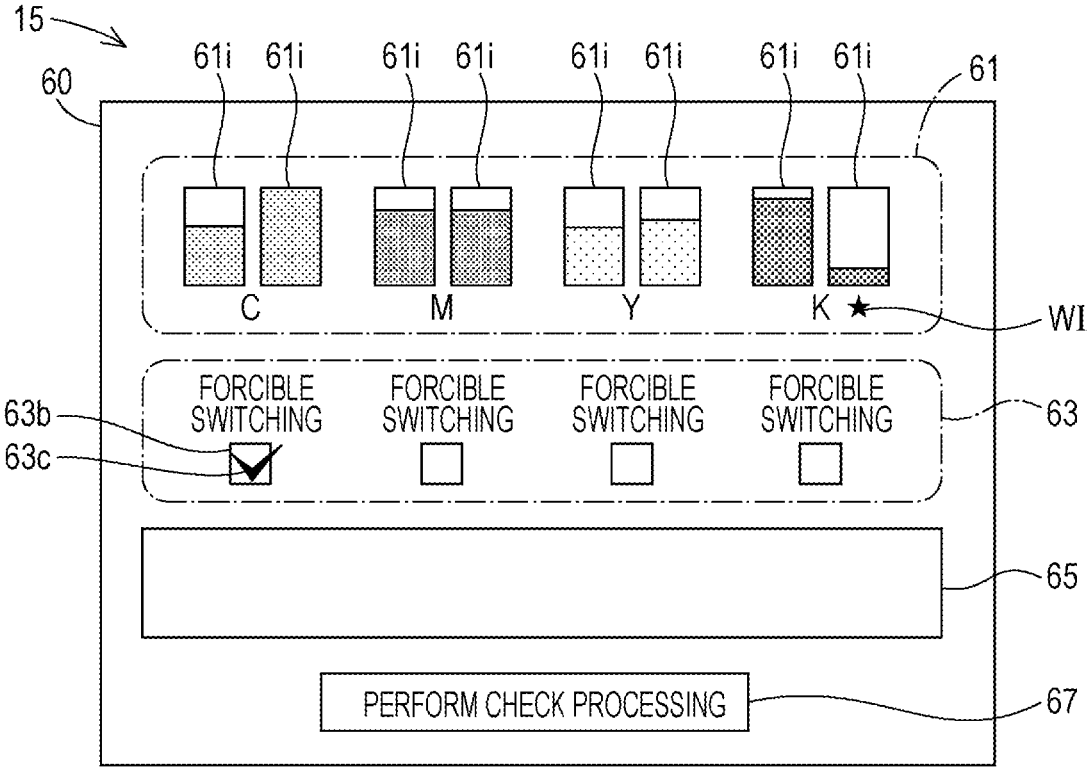
FIG. 3 is a schematic diagram showing an example of a notification screen displayed by a notification unit.

FIG. 3 is a schematic diagram showing an example of a notification screen 60 displayed by the notification unit 15. The notification screen 60 can be displayed at any time when the user operates the notification unit 15 or the operation unit 17 regardless whether or not the ink is being supplied. The notification screen 60 may be displayed by using rotation of a lever (not shown in the figures) provided to the holder 31 described above as a trigger. The notification screen 60 may be displayed with a case where one of the containers 50 is locked by the lever as a trigger. The notification screen 60 may be displayed with a case where the levers of all containers 50 that are not current supply sources of ink are brought into an engaged state as a trigger. In the present embodiment, the notification screen 60 includes a remaining amount display section 61, a setting operation section 63, a message display area 65, and an execution start button 67.

The remaining amount display section 61 is an area where indicators 61*i* that show an ink remaining amount in each container 50 are displayed. In the example of FIG. 3, the indicators 61*i* show the ink remaining amounts in a bar graph. In the remaining amount display section 61, the ink remaining amounts of the first container 51 and the second container 52 are displayed for each color ink. The control unit 11 causes the notification unit 15 to update the indicators 61*i* based on the remaining amount information RI of the storage unit 13.

The setting operation section 63 is an area where an operation image for the user to perform a setting operation of the forcible switching flag FLe is displayed. The user can set the forcible switching flag FLe by performing, for example, an operation to put a check mark 63*c* in a checkbox 63*b* which is provided for each color ink and displayed in the setting operation section 63.

In the message display area 65, a message for the user is displayed. An example of the message displayed in the message display area 65 will be described later. The execution start button 67 is an operation image for receiving an operation where the user instructs start of execution of container check processing described later. A mode of notification by the notification unit 15 is not limited to the notification screen 60 in FIG. 3. For example, the notification unit 15 may display each display item of the notification screen 60 in FIG. 3 on separate window screens.

1-4. Control Processing in Liquid Consumption Apparatus

1-4-1. Overview of Control Processing

Figure 4A:
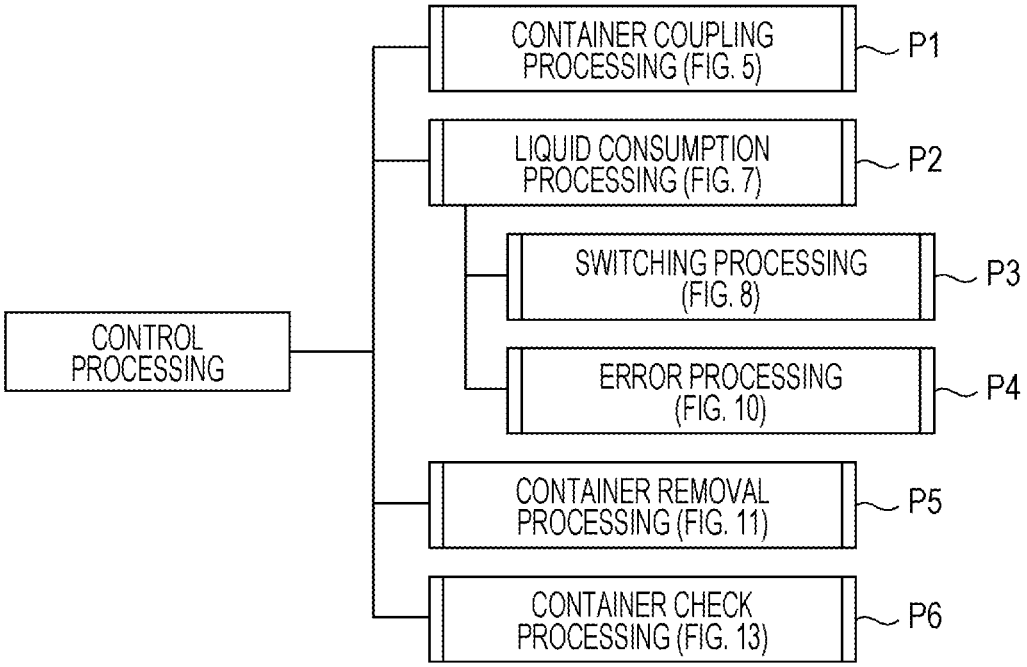
FIG. 4A is a first explanatory diagram showing an overview of control processing performed in the liquid consumption apparatus.

An overview of control processing performed in the liquid consumption apparatus 10 will be described with reference to FIGS. 4A and 4B. The control unit 11 performs processing P1 to P6 shown in FIG. 4A each time detecting an occurrence of an event to be a trigger of the processing as control processing of the liquid consumption apparatus 10. The processings P1 to P6 can be performed in parallel.

The first processing P1 is container coupling processing and is performed to establish coupling between the container 50 and the liquid consumption apparatus 10 when mounting of the container 50 into the holder 31 is detected. The second processing P2 is liquid consumption processing and is processing to cause the liquid supply unit 30 to supply ink to the liquid consumption unit 20 and cause the liquid consumption unit 20 to perform print processing. The third processing P3 is switching processing and is performed when a switching decision to switch the supply source of ink for the liquid consumption unit 20 is performed while the liquid consumption processing is being performed. The fourth processing P4 is error processing and is performed when an occurrence of a supply error is detected while the liquid consumption processing is being performed. The fifth processing P5 is container removal processing and is performed when a removal of the container 50 from the holder 31 is detected. The sixth processing P6 is the container check processing and is performed by an operation of a user.

Figure 4B:
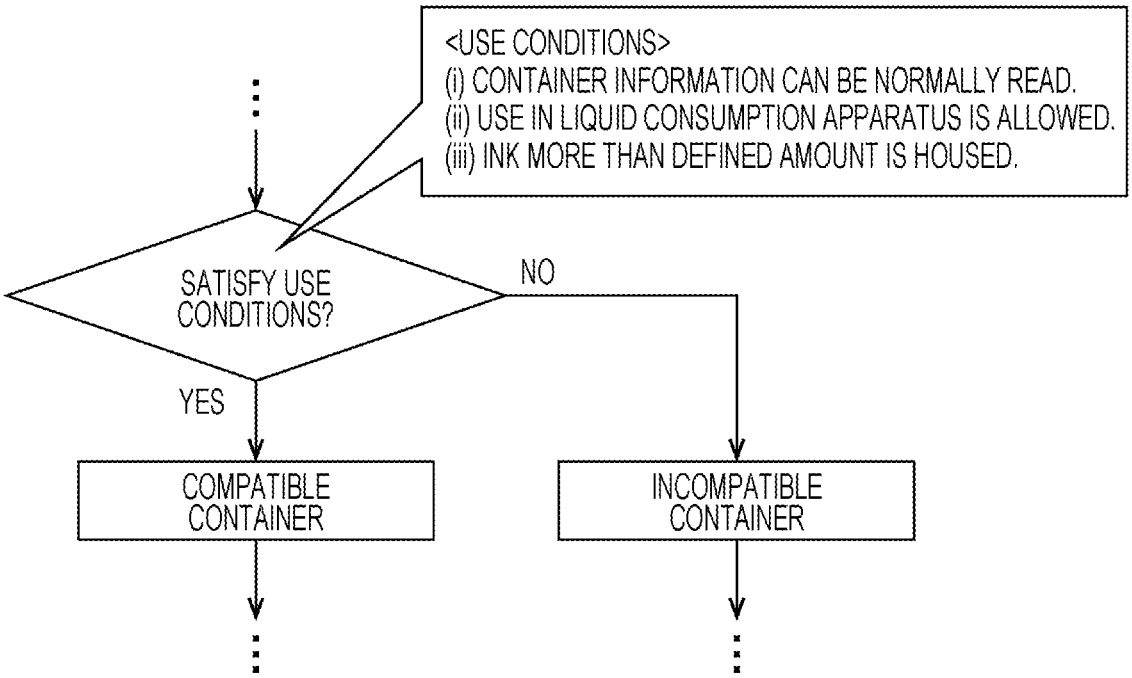
FIG. 4B is a second explanatory diagram showing an overview of control processing performed in the liquid consumption apparatus.

Refer to FIG. 4B. In the processings P1 to P6 described above, various determination processings that determine whether or not the container 50 mounted in the holder 31 satisfies predetermined use conditions are performed. In the present embodiment, determination on each of the following use conditions (i) to (iii) for the container 50 is individually performed in each processing P1 to P6.

(i) Container information CD can be normally read from the container side storage unit 56.

(ii) Use in the liquid consumption apparatus 10 is allowed.

(iii) Ink more than a predetermined defined amount is housed.

When the container 50 satisfies the use conditions (i) to (iii), the container 50 is processed as a suitable container. On the other hand, when it is detected that the container 50 does not satisfy any one of the use conditions (i) to (iii), the container 50 is processed as an unsuitable container. As described below, the switching of the supply source of ink to the liquid consumption unit 20 is controlled by results of the above determinations. Detailed flows of each processing P1 to P6 in FIG. 4A will be described in order below.

Figure 5:
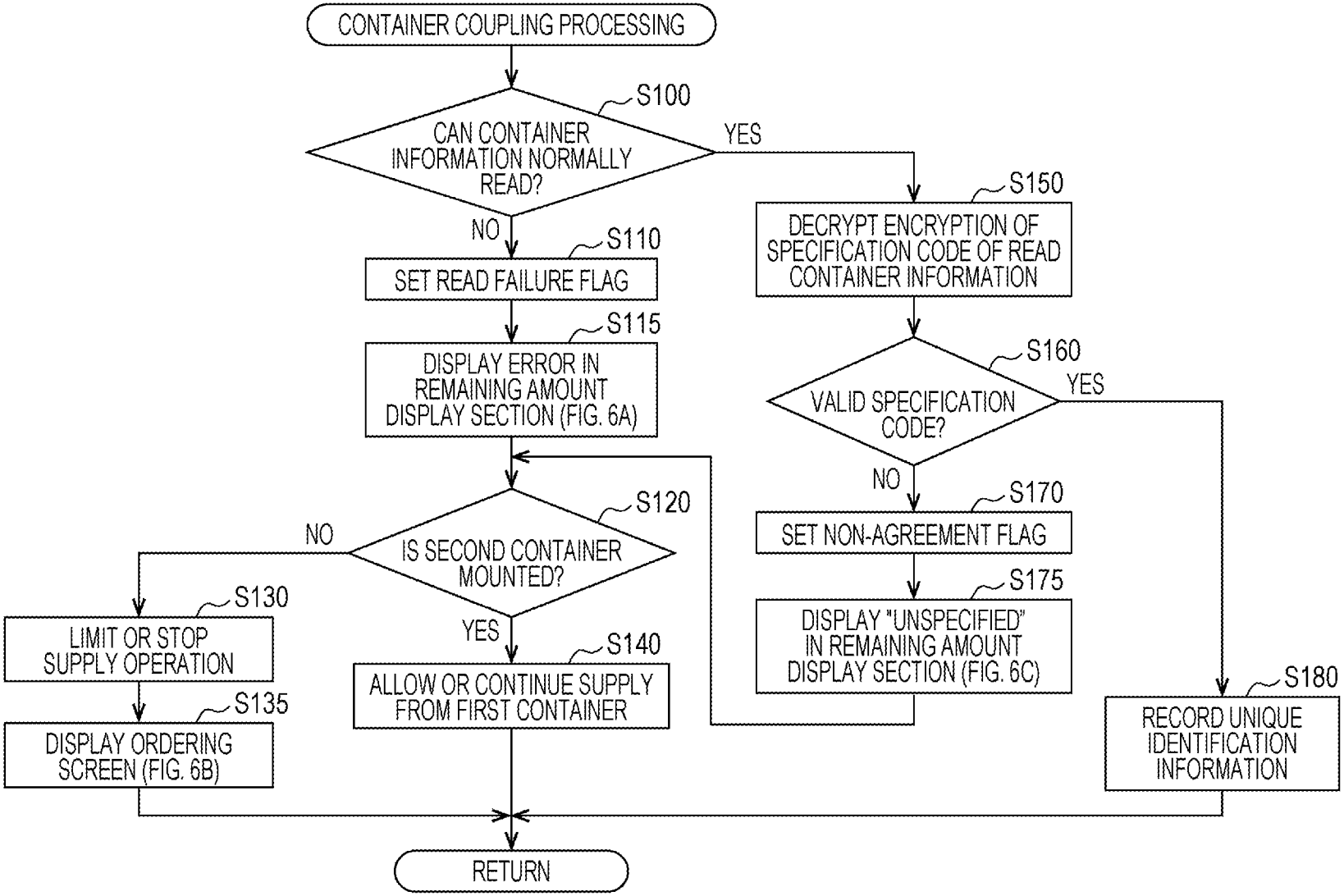
FIG. 5 is an explanatory diagram showing a flow of container coupling processing.

1-4-2. Container Coupling Processing:

FIG. 5 is an explanatory diagram showing a flow of the container coupling processing. The container coupling processing is started when the control unit 11 detects that a state in which there is an electrical contact between the electrical coupling section 36 of the holder 31 and the substrate section 55 of the container 50 changes into a state in which there is not the electrical contact.

In step S100, the control unit 11 determines whether or not the container information CD can be normally read from the container side storage unit 56 of the substrate section 55. That is, in step S100, whether or not the use condition (i) described above is satisfied is determined. The control unit 11 transmits a test signal to the substrate section 55, and when an appropriate response signal to the test signal is returned from the substrate section 55, the control unit 11 determines that the use condition (i) described above is satisfied. On the other hand, when the appropriate response signal is not returned, the control unit 11 determines that the use condition (i) described above is not satisfied.

When the control unit 11 determines that the use condition (i) is not satisfied, the control unit 11 sets the read failure flag FLa in step S110. The fact that the read failure flag FLa is set indicates that the container 50 is determined to be an unsuitable container that does not satisfy the use condition (i). When the control unit 11 sets the read failure flag FLa, the control unit 11 displays an error in the remaining amount display section 61 in the notification screen 60 of the notification unit 15 in step S115.

Figure 6A:
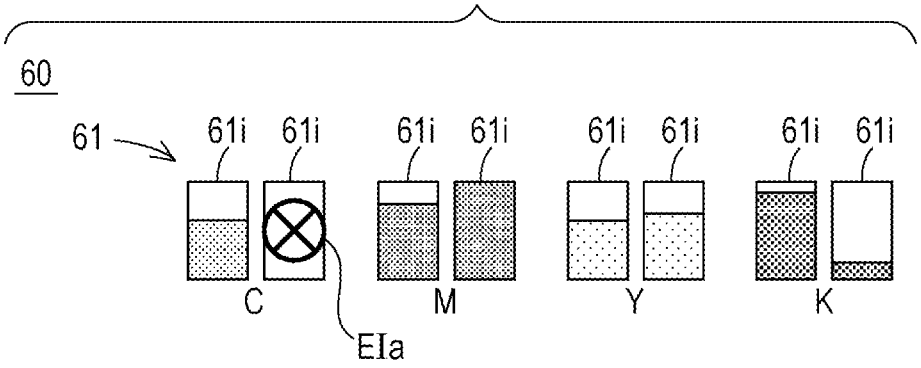
FIG. 6A is a schematic diagram showing an example of an error display when a read failure of container information is determined.

FIG. 6A is a schematic diagram showing an example of an error display when it is determined that the container information CD cannot be normally read from the container side storage unit 56 of the housing container 50. In this example, an error icon EIa made in the shape of X mark is displayed on the indicator 61*i* of the container 50 where a read failure of the container information CD is determined.

In step S120, the control unit 11 determines whether or not the container 50 that is detected to be mounted in the holder 31 is the second holder 52. When the container 50 that is detected to be mounted is not the second container 52 but the first container 51, the control unit 11 limits a supply operation of ink to the liquid consumption unit 20 by the liquid supply unit 30 in step S130. When the liquid consumption processing is being performed and ink is being supplied from the liquid supply unit 30 to the liquid consumption unit 20, the control unit 11 stops the supply of the ink. When the liquid consumption processing is not being performed, even if an execution of the liquid consumption processing is instructed from a user after this, the control unit 11 does not start execution of the liquid consumption processing and prevents supply of ink from the liquid supply unit 30 to the liquid consumption unit 20. Subsequently, in step S135, the control unit 11 displays an ordering screen including a message related to an order of a new container 50 for replacement through the notification unit 15.

Figure 6B:
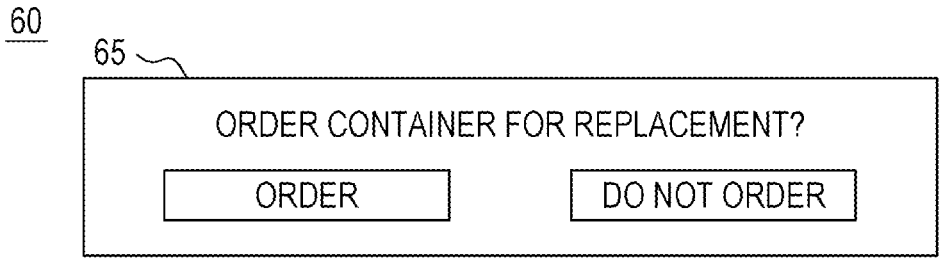
FIG. 6B is an explanatory diagram showing an example of an ordering screen.

FIG. 6B shows an example of the ordering screen. In this example, a message inquiring whether or not to make ordering is displayed in the message display area 65 in the notification screen 60 of FIG. 3. In the present embodiment, the control unit 11 receives an ordering operation by a user through the operation unit 17. When the user performs an ordering operation, the control unit 11 transmits information related to an order of the container 50 to a predetermined server through a network coupled to a communication unit not shown in FIG. 1. After step S135, the control unit 11 ends the container coupling processing.

When it is determined that the container 50 that is detected to be mounted in the holder 31 is the second holder 52 in step S120, the control unit 11 allows the supply operation of ink from the first container 51 without limiting the supply operation in step S140. Therefore, when the liquid consumption processing is being performed and ink is being supplied from the liquid supply unit 30 to the liquid consumption unit 20, the supply of the ink is continued. Alternatively, when an execution of the liquid consumption processing is instructed from the user after this, the supply of ink from the liquid supply unit 30 to the liquid consumption unit 20 is started. After step S140, the control unit 11 ends the container coupling processing.

In step S100, when the control unit 11 determines that information of the container 50 can be normally read through the substrate section 55, that is, when the control unit 11 determines that the container 50 is a suitable container that satisfies the use condition (i) described above, step S150 is performed. In step S150, the control unit 11 reads the container information CD stored in the container side storage unit 56 of the housing container 50. As described above, the information includes the encrypted specification code SC. The control unit 11 decrypts the encryption of the specification code SC.

In step S160, the control unit 11 determines validity of the specification code SC. Specifically, whether or not the use condition (ii) described above is satisfied is determined in step S160. When the specification code SC is not valid, the container 50 is an unsuitable container that is not allowed to be used in the liquid consumption apparatus 10. Therefore, in this case, the control unit 11 sets the non-agreement flag FLb in step S170. Further, in the following step S175, the control unit 11 displays that the container 50 is an unspecified container whose specification code SC is invalid in the remaining amount display section 61 in the notification screen 60 of the notification unit 15.

Figure 6C:
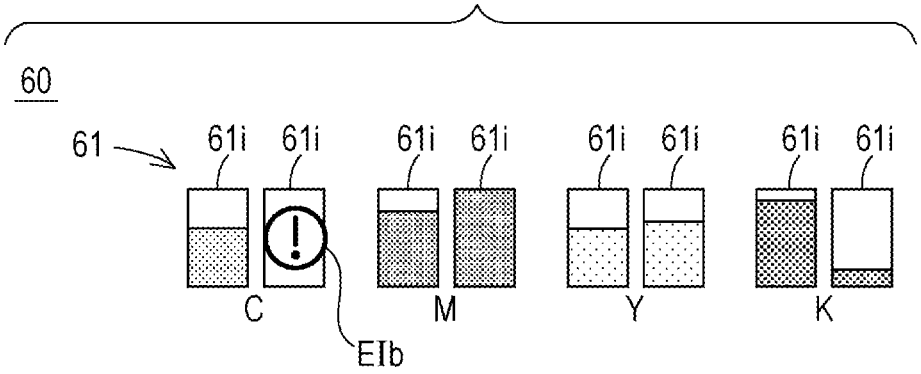
FIG. 6C is a schematic diagram showing a display example in a remaining amount display section when mounting of an unspecified container is detected.

FIG. 6C is a schematic diagram showing a display example in the remaining amount display section 61 when it is detected that the mounted container 50 is an unspecified container. In this example, an error icon EIb made in the shape of an exclamation mark is displayed on the indicator 61*i* of the container 50 that is determined to be an unspecified unsuitable container.

After updating the display of the remaining amount display section 61 in step S175, the control unit 11 performs processing of step S120 and subsequent steps described above. Therefore, when the container 50 that is determined to be an unspecified container is the first container 51, the supply operation of ink by the liquid supply unit 30 is limited in step S130, and an ordering screen of a container 50 for replacement is displayed in step S135. When the container 50 that is determined to be an unspecified container is the second container 52, the supply of ink from the first container 51 is allowed in step S140.

When the specification code SC is determined to be valid in step S160, the mounted container 50 is processed as a suitable container that satisfies the use condition (ii) described above. In this case, in step S180, the control unit 11 records the unique identification information UI of the container information CD by causing the storage unit 13 to store the unique identification information UI. Further, the control unit 11 records the remaining amount information RI of the container information CD in the storage unit 13 and updates the display of the indicator 61*i* in the remaining amount display section 61 based on the remaining amount information RI. After step S180, the control unit 11 ends the container coupling processing.

Figure 7:
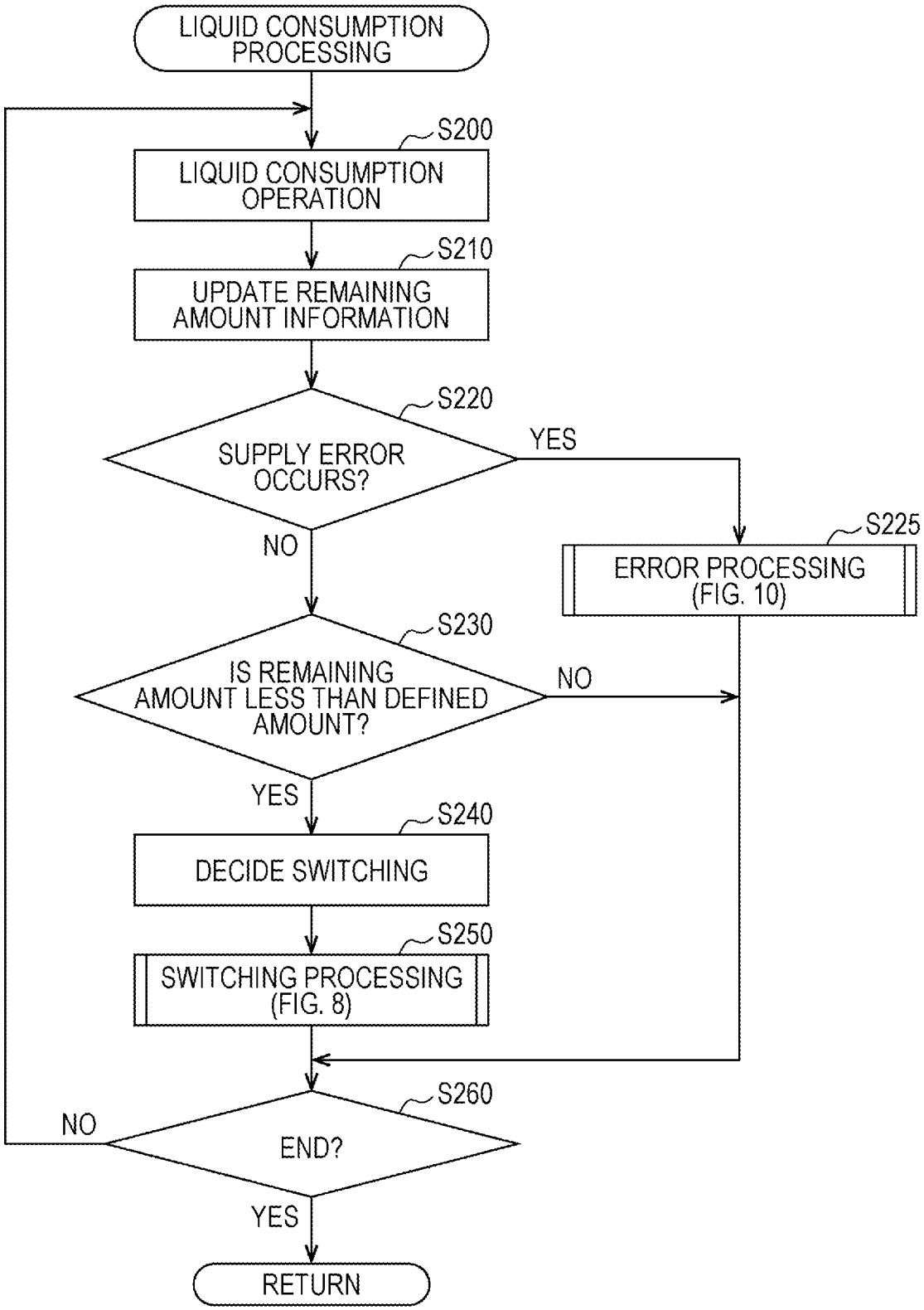
FIG. 7 is an explanatory diagram showing a flow of liquid consumption processing.

1-4-3. Liquid Consumption Processing:

FIG. 7 is an explanatory diagram showing a flow of the liquid consumption processing. The liquid consumption processing is started, for example, when print data is inputted into the control unit 11 through the communication unit not shown in FIG. 1 or when the control unit 11 receives an instruction from a user.

In step S200, the control unit 11 causes the liquid consumption apparatus 10 to perform a liquid consumption operation in which ink is supplied from the liquid supply unit 30 to the liquid consumption unit 20 and print processing is performed by the liquid consumption unit 20. In step S210, the control unit 11 updates the remaining amount information RI of each container 50 based on an ink consumption amount in step S200. Further, the control unit 11 causes the notification unit 15 to update the display of the indicator 61*i* of each container 50 in the remaining amount display section 61 based on the updated remaining amount information RI.

In step S220, the control unit 11 determines whether or not a supply error occurs in any of the containers 50 that are ink supply sources. The "supply error" is an error caused by stagnation of supply of ink from the container 50. The control unit 11 determines that the supply error occurs, for example, when a shortage of flow rate of ink from the housing container 50 is detected by the sensor mechanism 42 although the ink remaining amount indicated by the remaining amount information RI is more than a defined amount. The supply error also occurs when the supply of ink is continued while the switching mechanism 40 does not switch the supply source after the ink remaining amount indicated by the remaining amount information RI becomes less than the defined amount and thereby the shortage of ink supplied to the liquid consumption unit 20 is detected by the sensor mechanism 42.

When the supply error is detected in step S220, error processing in step S225 is performed. The error processing will be described later. When the supply error is not detected in step S220, a determination for the ink remaining amount in each container 50 that is an ink supply source is performed in step S230. The control unit 11 determines whether or not the ink remaining amount of each container 50 that is an ink supply source is less than a predetermined defined amount that is a lower limit reference value of the ink remaining amount based on the remaining amount information RI. In other words, whether or not the use condition (iii) described above is satisfied is determined in step S230. The defined amount that is a determination threshold may be, for example, about 5 to 10% of the maximum amount of ink that can be housed in the container 50.

When an unsuitable container whose ink remaining amount is less than the defined amount is detected in step S230, the control unit 11 performs a switching decision to switch the container 50 that is the supply source of ink to the liquid consumption unit 20 by the switching mechanism 40 in step S240. In this case, the control unit 11 performs switching processing described later in step S250.

When an unsuitable container whose ink remaining amount is less than the defined amount is not detected in step S230, the control unit 11 performs end determination of the liquid consumption processing in step S260. The control unit 11 ends the liquid consumption processing when the print processing is completed and repeats step S200 and subsequent steps when the print processing is not completed.

Figure 8:
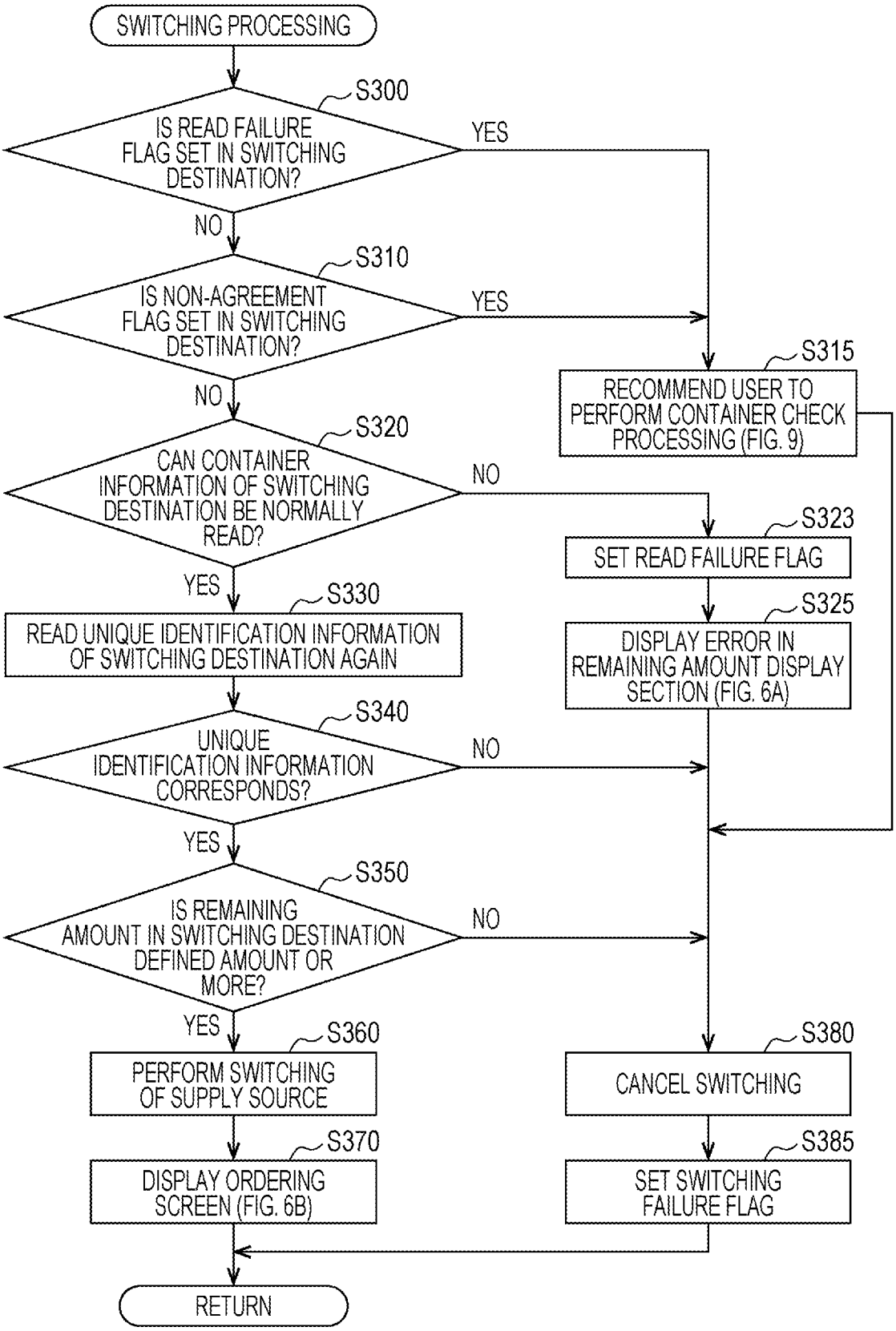
FIG. 8 is an explanatory diagram showing a flow of switching processing.

1-4-4. Switching Processing:

FIG. 8 is an explanatory diagram showing a flow of the switching processing. The switching processing is processing that switches the supply source of ink to the liquid consumption unit 20 from the first container 51 to the second container 52 or from the second container 52 to the first container 51. When the container 50 that is the current ink supply source is the first container 51, a switching destination container 50 is the second container 52 and when the container 50 that is the current ink supply source is the second container 52, the switching destination container 50 is the first container 51. However, as described below, in the switching processing, when the switching destination container 50 is an unsuitable container, the switching is cancelled.

In step S300, the control unit 11 determines whether or not the read failure flag FLa is set for the switching destination container 50. When the read failure flag FLa is set, the container 50 is an unsuitable container from which the container information CD cannot be correctly read. When it is determined that the read failure flag FLa is not set in step S300, the control unit 11 determines whether or not the non-agreement flag FLb is set in step S310. When the non-agreement flag FLb is set, the container 50 is an unsuitable container that is not allowed to be used in the liquid consumption apparatus 10.

When the read failure flag FLa is set in step S300 or when the non-agreement flag FLb is set in step S310, the control unit 11 performs processing of step S315. In step S315, the control unit 11 displays a message recommending a user to perform the container check processing described later through the notification unit 15.

Figure 9:
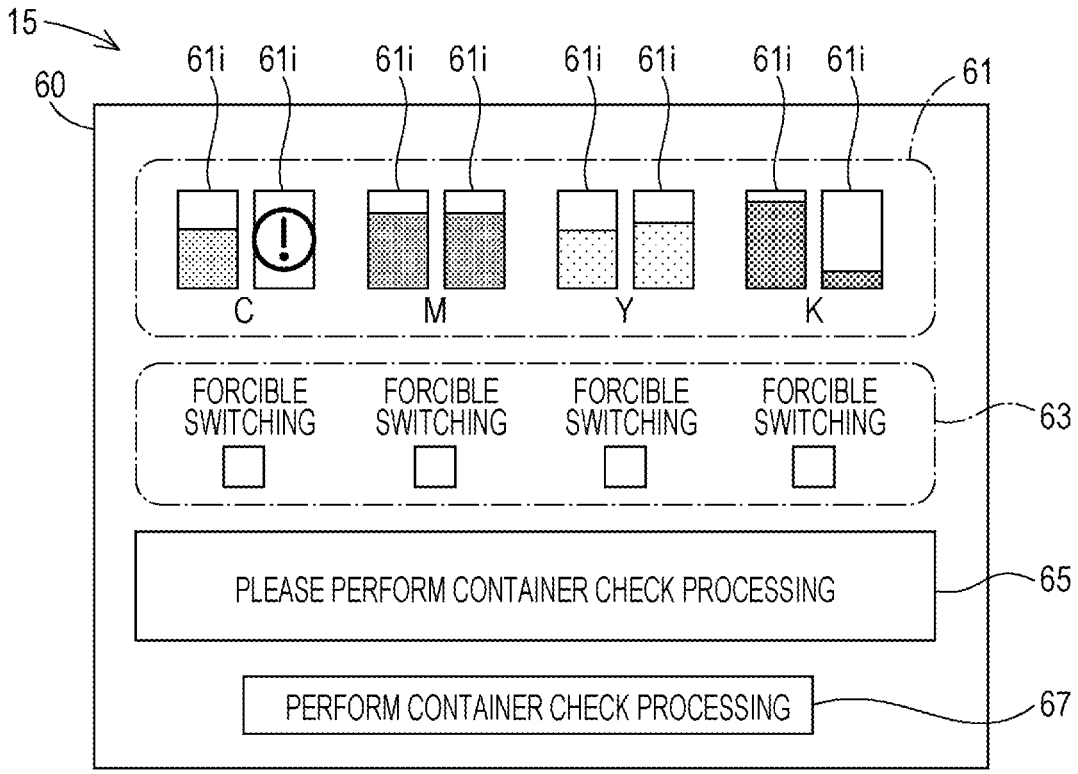
FIG. 9 is a schematic diagram showing an example of a message display prompting a user to perform container check processing.

FIG. 9 is a schematic diagram showing an example of a message display prompting a user to perform the container check processing. FIG. 9 illustrates a state in which "Please perform container check processing" is displayed in the message display area 65 of the notification screen 60. As described above, execution of the container check processing is started when a user performs an operation to press the execution start button 67 on the notification screen 60. The reason why the user is prompted to perform the container check processing is to inquire the user about handling of an unsuitable container by the container check processing. The container check processing will be described later.

After execution of step S315, when the container check processing is performed by an operation of the user, the control unit 11 decides to cancel the switching of the supply source of ink in step S380. Further, in step S385, the control unit 11 sets the switching failure flag FLd shown in FIG. 3. In this case, the switching processing ends without switching the supply source of ink.

In steps S300 and S310, when neither the read failure flag FLa nor the non-agreement flag FLb is set in the switching destination container 50, at present, the container 50 has no history where the container 50 has been determined to be an unsuitable container. In steps S320 to S350, the control unit 11 determines whether or not the switching destination container 50 corresponds to an unsuitable container at present.

In step S320, in the same manner as in step S100 in the container coupling processing of FIG. 5, the control unit 11 determines whether or not the container information CD can be normally read from the container side storage unit 56 of the switching destination container 50. Step S320 corresponds to determination processing that determines whether or not the use condition (i) described above is satisfied. The reason why the determination is performed is because there is a possibility that a contact state between the substrate section 55 of the container 50 and the electrical coupling section 36 of the holder 31 is changed or a possibility that the container 50 is replaced by some sort of foul means after the coupling processing for the container 50 is performed.

When it is determined that the switching destination container 50 is an unsuitable container whose container information CD cannot be normally read from the container side storage unit 56, the control unit 11 sets the read failure flag FLa of the switching destination container 50 in step S323. In step S325, in the same manner as in step S115 in the coupling processing of FIG. 5, an error display as shown in FIG. 6A is performed on the remaining amount display section 61 of the notification screen 60 displayed by the notification unit 15. Subsequently, the control unit 11 decides to cancel the switching of the supply source of ink in step S380. The control unit 11 sets the switching failure flag FLd in step S385 and ends the switching processing without switching the supply source of ink.

When the control unit 11 determines that the container information CD can be normally read from the container side storage unit 56 of the switching destination container 50 in step S320, the control unit 11 reads the unique identification information UI from the container side storage unit 56 of the switching destination container 50. The unique identification information UI is read once in step S180 of the coupling processing shown in FIG. 5 and recorded in the storage unit 13. In step S340, the control unit 11 determines whether or not the unique identification information UI already stored in the storage unit 13 coincides with the unique identification information UI read again in step S320. When the two pieces of unique identification information UI coincide with each other, it is possible to authenticate that the switching destination container 50 is the same as the suitable container where the validity of the specification code is confirmed in step S160. That is, step S340 corresponds to determination processing that determines whether or not the switching destination container 50 satisfies the use condition (ii). According to the processing of steps S320 to S340, it is possible to quickly and easily confirm the validity of the specification code recorded in the switching destination container 50 by using the unique identification information UI recorded in the coupling processing without decrypting the encryption of the specification code.

In step S350, the control unit 11 determines whether or not ink more than a defined amount is housed in the switching destination container 50 based on the remaining amount information RI of the switching destination container 50 stored in the storage unit 13. Step S350 corresponds to determination processing that determines whether or not the switching destination container 50 satisfies the use condition (iii) described above.

When the coincidence of the two pieces of unique identification information UI cannot be confirmed in step S340 or when the ink remaining amount in the switching destination container 50 is less than the defined amount in step S350, the switching destination container 50 is an unsuitable container. Therefore, in this case, the control unit 11 decides to cancel the switching in step S380 and sets the switching failure flag FLd in step S385. The control unit 11 ends the switching processing without switching the supply source of ink.

When the ink remaining amount in the switching destination container 50 is more than or equal to the defined amount in step S350, the control unit 11 causes the switching mechanism 40 to perform a switching operation to switch the supply source of ink to the switching destination container 50 in step S360. Thereby, it is possible to stably continue the supply operation of ink to the liquid consumption unit 20 by the liquid supply unit 30 without interrupting the supply operation of ink. In step S370, the control unit 11 displays a message related to an order of a new container 50 as shown in FIG. 6B through the notification unit 15 in order to cause a user to replace the container 50 where the ink remaining amount becomes small. Thus, the control unit 11 ends the switching processing.

1-4-5. Error Processing

Figure 10:
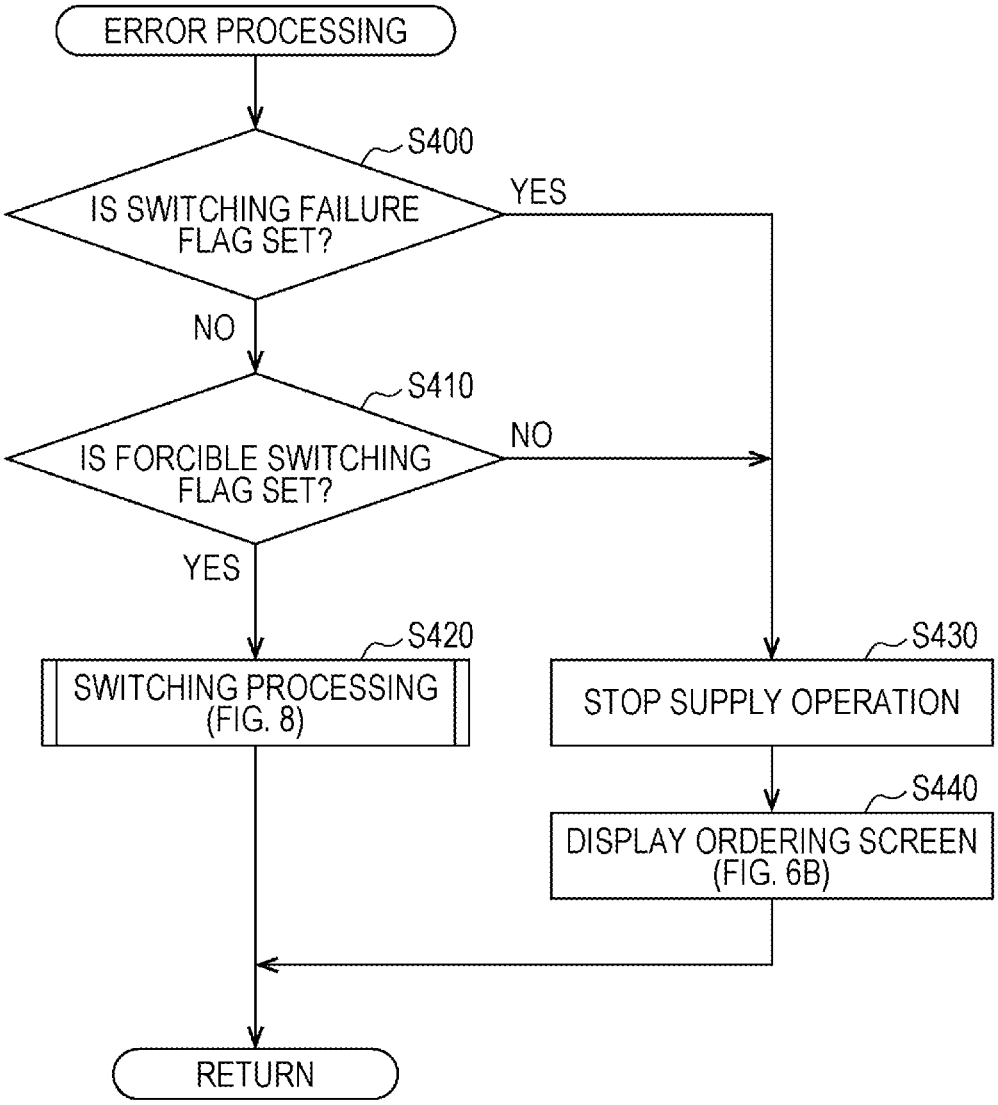
FIG. 10 is an explanatory diagram showing a flow of error processing.

FIG. 10 is an explanatory diagram showing a flow of the error processing. As described above, the error processing is performed when the supply error occurs where the supply of ink to the liquid consumption unit 20 is stagnated while the liquid consumption processing shown in FIG. 7 is being performed.

In step S400, the control unit 11 determines whether or not the switching failure flag FLd of the switching mechanism 40 coupled to the container 50 where occurrence of the supply error is detected is set. The fact that the switching failure flag FLd is set indicates that there is a history that the switching of the supply source of ink is cancelled in the switching processing. Therefore, when the switching failure flag FLd is set, the control unit 11 stops the ink supply operation performed by the liquid supply unit 30 and interrupts the print processing that is the liquid consumption operation performed by the liquid consumption unit 20 in step S430. In step S440, the control unit 11 displays a message related to an order of a new container 50 as shown in FIG. 6B through the notification unit 15 in order to cause a user to replace the container 50 that causes the supply error.

When the switching failure flag FLd is not set in step S400, the control unit 11 determines whether or not the forcible switching flag FLe is set in step S410. As described above, the forcible switching flag FLe is set by a user's setting operation on the setting operation section 63 in the notification screen 60 displayed by the notification unit 15 shown in FIG. 3. When the forcible switching flag FLe is set, the user allows forcible switching of the supply source of ink by the control unit 11. Therefore, in this case, the control unit 11 performs the switching processing in FIG. 8 in step S420 and ends the error processing. By performing the switching processing, when a standby container 50 that is not the supply source of ink at present is not an unsuitable container, the supply source of ink is switched to the standby container 50 and the ink supply operation performed by the liquid supply unit 30 can be continued.

When the forcible switching flag FLe is not set in step S410, the control unit 11 stops the ink supply operation performed by the liquid supply unit 30 and interrupts the liquid consumption operation performed by the liquid consumption unit 20 in step S430. The control unit 11 performs step S430 even when any error occurs in the container 50 that is the current supply source of ink or in a flow path coupled to the container 50. This is because the fact that the forcible switching flag FLe is not set indicates that the user does not allow forcible switching of the supply source of ink by the control unit 11. The control unit 11 further displays an ordering screen for replacing the container 50 in step S440 in the same manner as described above. Thus, the error processing ends.

1-4-6. Container Removal Processing

Figure 11:
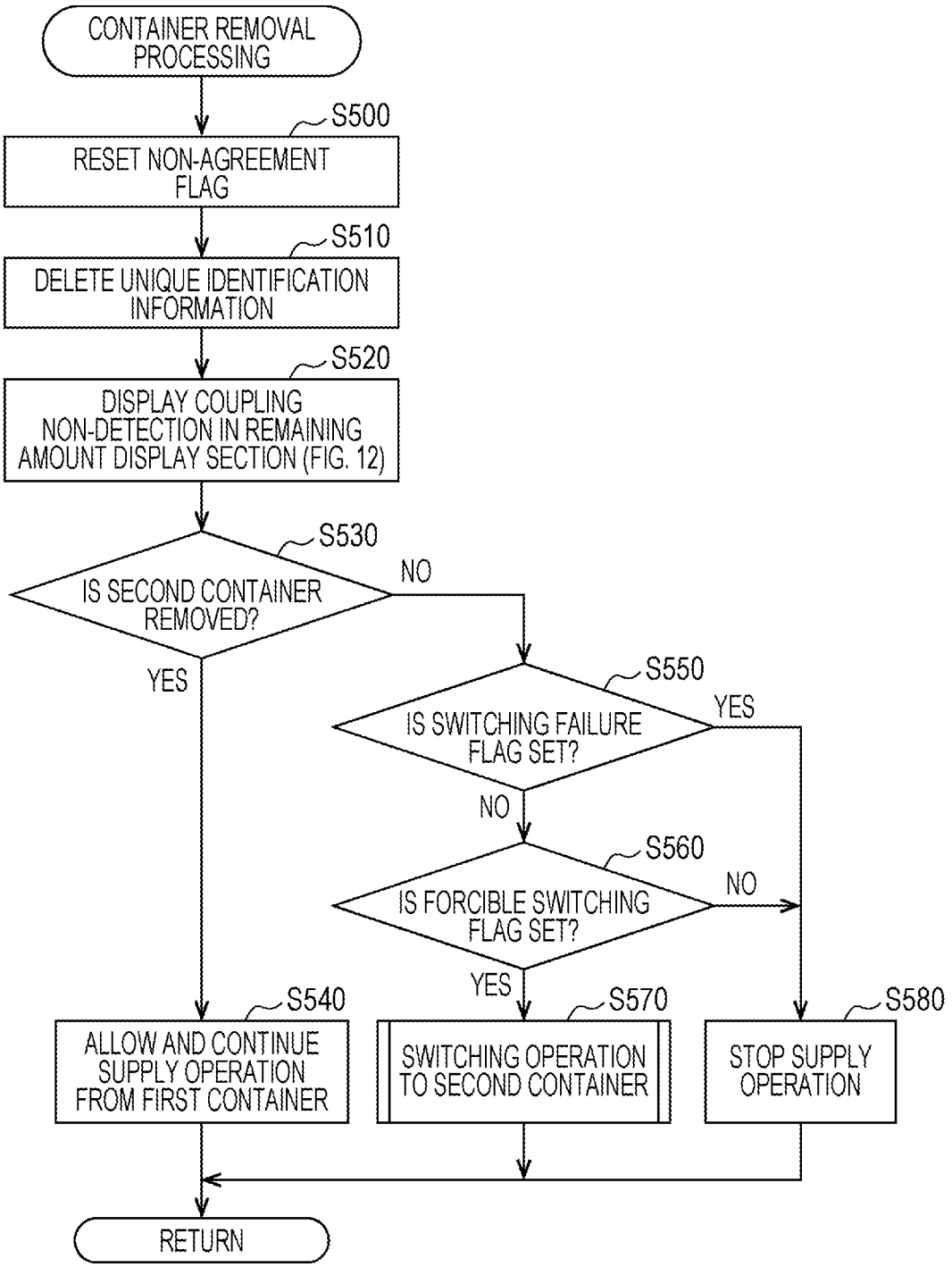
FIG. 11 is an explanatory diagram showing a flow of container removal processing.

FIG. 11 is an explanatory diagram showing a flow of the container removal processing. The container removal processing is started when the control unit 11 detects that a state in which there is not an electrical contact between the electrical coupling section 36 of the holder 31 and the substrate section 55 of the container 50 transits to a state in which there is the electrical contact.

In step S500, the control unit 11 resets the non-agreement flag FLb of a container 50 whose removal from the holder 31 is detected. Thereby, the non-agreement flag FLb of the container 50 is set to an initial value. In step S510, the control unit 11 deletes the unique identification information UI stored in the storage unit 13. In step S520, the control unit 11 displays that the container 50 is not detected in the remaining amount display section 61 in the notification screen 60 displayed by the notification unit 15. "The container 50 is not detected" means a state in which an electrical contact with the substrate section 55 of the container 50 cannot be detected and mounting of the container 50 into the holder 31 is not detected.

Figure 12:
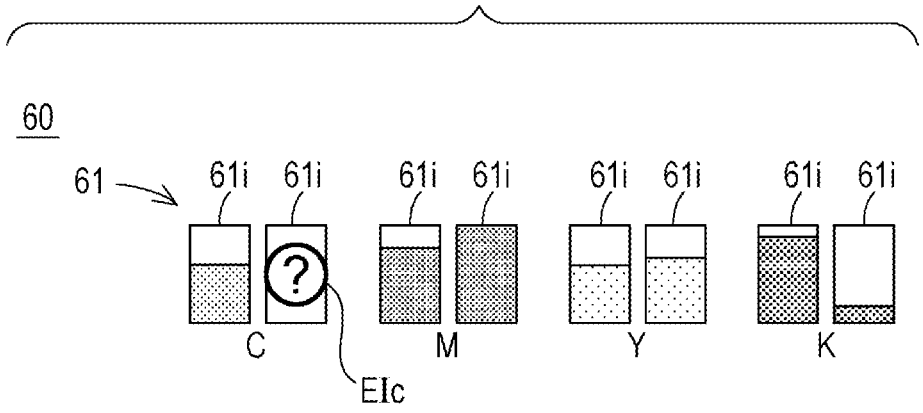
FIG. 12 is a schematic diagram showing a display example showing that a housing container is not detected.

FIG. 12 is a schematic diagram showing an example of a display showing that the container 50 is not detected. In this example, an error icon EIc made in the shape of a question mark is displayed on an indicator 61*i* corresponding to the container 50 that is not detected.

In step S530, whether or not the removed container 50 is the second container 52 is determined. When the removed container 50 is the second container 52, the control unit 11 makes a decision to allow the supply operation of ink from the first container 51 without limiting the supply operation in step S540 and ends the container removal processing. Thereby, the supply of ink to the liquid consumption unit 20 can be continued without delay even if the second container 52 is removed from the holder 31 while the ink is being supplied from the first container 51 to the liquid consumption unit 20.

In step S530, the removed container 50 is not the second container 52 but the first container 51, the control unit 11 performs processing of step S550 and subsequent steps. In step S550, the control unit 11 determines whether or not the switching failure flag FLd of the switching mechanism 40 coupled to the removed first container 51 is set. When the switching failure flag FLd is set, there is a history that the switching of the supply source of ink to the second container 52 is cancelled. Therefore, in this case, the control unit 11 decides to stop the supply operation of the liquid supply unit 30 to the liquid consumption unit 20 in step S580. Thereby, when the liquid consumption processing is being performed, the liquid consumption processing is interrupted. Alternatively, when the liquid consumption processing is not being performed, an execution of the liquid consumption processing is prevented from being started. Thus, the control unit 11 ends the container removal processing.

When the switching failure flag FLd is not set in step S550, the control unit 11 determines whether or not the forcible switching flag FLe of the switching mechanism 40 coupled to the removed first container 51 is set in step S560. When the forcible switching flag FLe is not set, the user does not allow forcible switching of the supply source of ink by the control unit 11. Therefore, in this case, in the same manner as described above, the control unit 11 decides to stop the supply operation of the liquid supply unit 30 to the liquid consumption unit 20 in step S580. On the other hand, when the forcible switching flag FLe is set in step S560, the user allows forcible switching of the supply source of ink by the control unit 11. Therefore, in this case, the control unit 11 performs the switching processing of FIG. 8 in order to switch the supply source of ink to the second container 52 in step S570 and ends the container removal processing.

Figure 13:
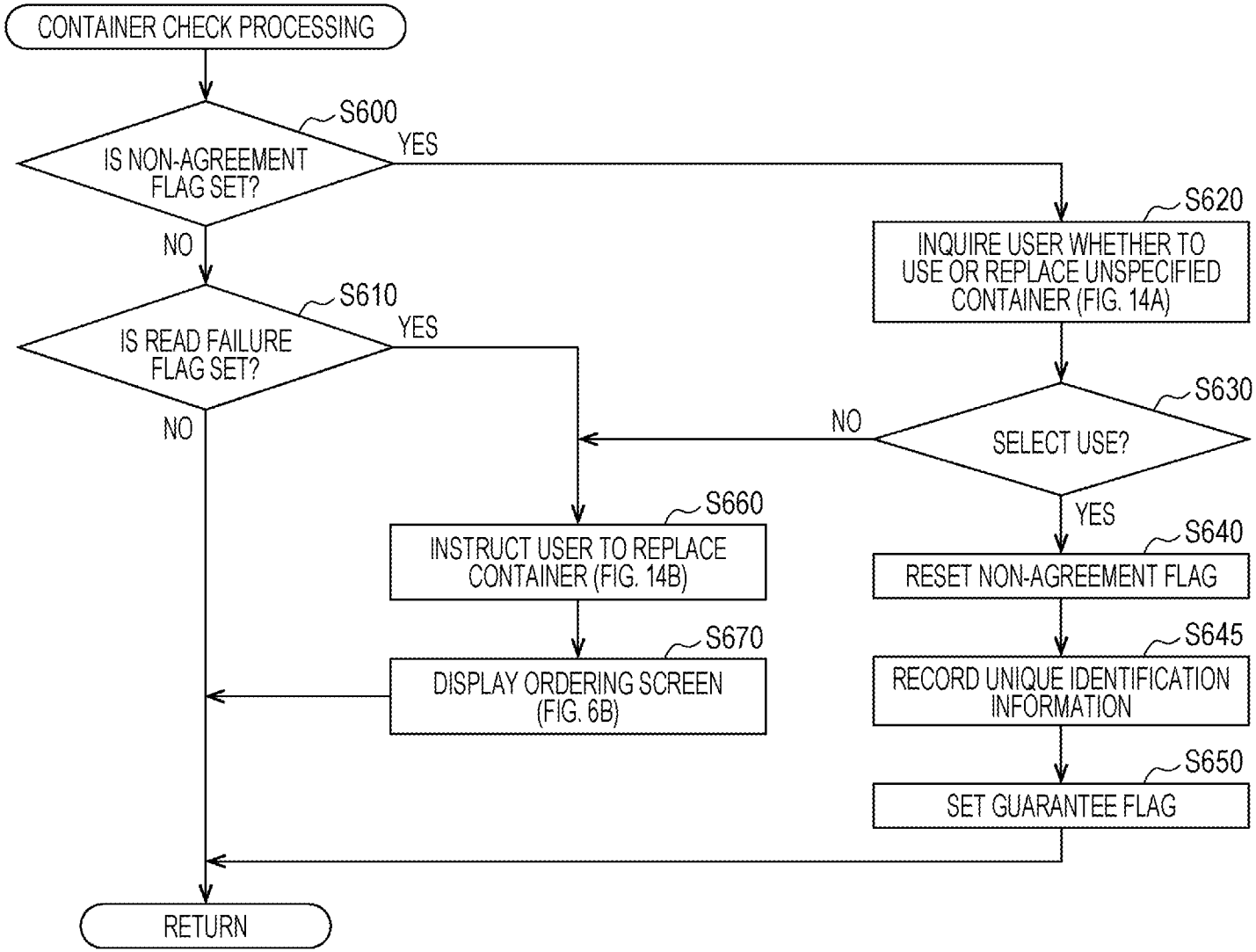
FIG. 13 is an explanatory diagram showing a flow of container check processing.

1-4-7. Container Check Processing:

FIG. 13 is an explanatory diagram showing a flow of the container check processing. As described above, the container check processing is started when a user's operation of pressing the execution start button 67 on the notification screen 60 shown in FIG. 3 is detected.

In step S600, the control unit 11 determines whether or not there is a container 50 where the non-agreement flag FLb is set among the containers 50 mounted in the holders 31. When there is no container 50 where the non-agreement flag FLb is set, in step S610, the control unit 11 determines whether or not there is a container 50 where the read failure flag FLa is set. When there is no container 50 where the read failure flag FLa is set, the control unit 11 ends the container check processing without doing anything. This is because, in this case, no unsuitable container is detected among the containers 50 mounted in the in the holders 31.

When there is a container 50 where the non-agreement flag FLb is set in step S600, in step S620, the control unit 11 inquires the user whether or not the user will use an unspecified container 50 where the non-agreement flag FLb is set through the notification unit 15.

Figure 14A:
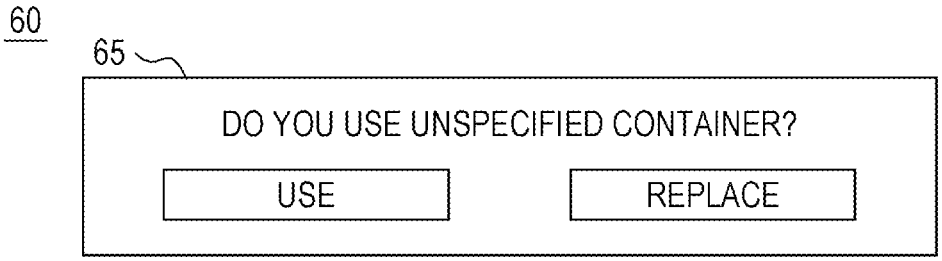
FIG. 14A is a schematic diagram showing a display example of an inquiry message to a user.

FIG. 14A shows a display example of an inquiry message to a user on the notification screen 60 displayed by the notification unit 15. The control unit 11 displays a message for causing the user to select "use" or "replace" of the unspecified container 50 in the message display area 65 of the notification screen 60 displayed by the notification unit 15. In step S630, the control unit 11 receives a selection operation of the user.

When the user selects the use of the unspecified container 50, the control unit 11 resets the non-agreement flag FLb set in the container 50 in step S640. Thereby, the non-agreement flag FLb is set to an initial value. In step S645, the control unit 11 records the unique identification information UI of the container 50, where the non-agreement flag FLb is reset, in the storage unit 13 in the same manner as in step S180 in the container coupling processing of FIG. 5. Thereby, it is possible to restrain the same container 50 from being determined later to be an unspecified unsuitable container. In the subsequent step S650, the control unit 11 sets the guarantee flag FLc of the container 50 where the non-agreement flag FLb is reset. This is because an unspecified container 50 is out of the scope of the charged guarantee. For example, as shown in FIG. 3, the control unit 11 displays a warning icon WI for warning the user that the charged guarantee is not applied below the indicator 61*i* of the container 50. The control unit 11 ends the container check processing. Thereby, in the subsequent processing, an unspecified container 50 is not determined to be an unsuitable container that is not allowed to be used in the liquid consumption apparatus 10. Therefore, the user can perform the container check processing again at an arbitrary timing. The control unit 11 may continuously store the remaining amount information RI of the container information CD of the container 50 whose continuous use is selected in the storage unit 13 and continuously update the display of the indicator 61*i* of the remaining amount display section 61 based on the remaining amount information RI in the storage unit 13.

Figure 14B:
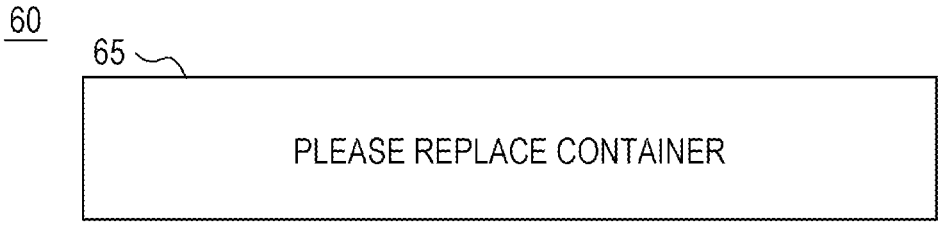
FIG. 14B is a schematic diagram showing an example of a message instructing a user to perform a replacing work of an unsuitable container.

When a container 50 where the read failure flag FLa is set is detected in step S610 or when the user does not select the use of the unspecified container 50 but selects the replace of the unspecified container 50 in step S630, the control unit 11 performs processing of step S660. In step S660, as shown in FIG. 14B, the control unit 11 displays a message instructing the user to perform a replacing work of an unsuitable container in the message display area 65 of the notification screen 60 displayed by the notification unit 15. Further, in step S670, the control unit 11 displays an ordering screen including a message related to an order of a new container 50 as shown in FIG. 6B through the notification unit 15 and ends the container check processing.

Here, a case will be described where, in the switching processing of FIG. 8, it is determined that the non-agreement flag FLb is set in the switching destination container 50 in step S310 and the user instructs execution of the container check processing according to the message displayed by the control unit 11 in step S315. Also in this case, as described above, the user can select whether to replace or use the unspecified container 50 that is the switching destination in step S620 of FIG. 13. When the user selects replace, the container check processing is completed through processing of steps S660 and S670, the processing returns to the switching processing of FIG. 8, and cancellation of the switching is decided in step S380.

On the other hand, when the user selects use of the unspecified container 50, as described above, the non-agreement flag FLb of the unspecified container 50 is reset in step S640, the container check processing ends, and the processing returns to the switching processing of FIG. 8. Even in this case, in steps S380 and S385 subsequent to step S315, the switching of the supply source of ink is once cancelled. However, in this case, when the processing thereafter returns to the liquid consumption processing of FIG. 7 and the switching processing of step S250 is performed again, the non-agreement flag FLb has been reset, so that the unspecified container 50 is switched to the supply source of ink if another factor to be determined as an unsuitable container is not detected.

By the way, in the container check processing of FIG. 13, as described above, the determination about the non-agreement flag FLb is performed in step S600 and then the determination about the read failure flag FLa is performed in step S610. Thereby, when the non-agreement flag FLb is set in step S600, the determination about the read failure flag FLa is not performed. This is because the fact that the non-agreement flag FLb is set indicates that the specification code SC has already been read and determined and it can be determined that the container 50 is in a state in which the container information CD can be normally read without performing the determination about the read failure flag FLa. Therefore, the determination about the read failure flag FLa can be omitted, and accordingly the timing of sending inquiry to the user in step S620 can be is advanced.

1-5. Conclusion

According to the liquid consumption apparatus 10 of the present embodiment, in each processing, it is determined whether the container 50 is a suitable container that satisfies the use conditions or an unsuitable container that does not satisfy the use conditions in a period from when the container is mounted in the holder 31 to when the container 50 is removed from the holder 31. Therefore, it is possible to restrain the use of the container 50 from being allowed although the container 50 is an unsuitable container. When the ink remaining amount of the first container 51 becomes less than the defined amount while the ink is being supplied from the first container 51 to the liquid consumption unit 20 and the first container 51 is determined to be an unsuitable container, the switching decision to switch the supply source of ink to the second container 52 is performed. When the switching of the supply source of ink from the first container 51 to the second container 52 is performed, it is possible to cause the liquid consumption apparatus 10 to operate for a long time even if the user does not perform the replacing work of the container 50.

According to the liquid consumption apparatus 10 of the present embodiment, while the ink is being supplied from the first container 51 to the liquid consumption unit 20, the supply operation of ink from the first container 51 to the liquid consumption unit 20 is continued regardless of whether or not the second container 52 is an unsuitable container until when the switching of the ink supply source from the first container 51 to the second container 52 is decided. Therefore, for example, even when the second container 52 is mounted and the second container 52 is determined to be an unsuitable container in the coupling processing while the ink is being supplied from the first container 51 to the liquid consumption unit 20, the supply operation of ink from the first container 51 is continued. After the ink supply source is switched from the second container 52 to the first container 51, even when the second container 52 that is an unsuitable container whose ink remaining amount is less than the defined amount is still mounted, the supply operation of ink from the first container 51 is continued. As described above, according to the liquid consumption apparatus 10 of the present embodiment, it is suppressed that the supply operation of ink from the first container 51 is obstructed and the liquid consumption operation of the liquid consumption unit 20 is interrupted by a suitability determination on the second container 52. Further, according to the liquid consumption apparatus 10 of the present embodiment, even when a mounting/unmounting operation of the second container 52 is performed while the ink is being supplied from the first container 51 to the liquid consumption unit 20, the supply operation of ink from the first container 51 is not interrupted. Therefore, the user can remove the second container 52 and perform a stirring work for stirring ink by swinging the second container 52 while ink is being supplied from the first container 51 to the liquid consumption unit 20.

According to the liquid consumption apparatus 10 of the present embodiment, for example, even when the second container 52 is determined to be an unsuitable container whose ink remaining amount is less than the defined amount, the supply of ink from the first container 51 can be continued while the second container 52 is still mounted in the holder 31. Therefore, it is possible to restrain a tip opening section of the ink receiving section 35 for the second container 52 from being exposed to external air for a long time while the second holder 52 is removed from the holder 31 because the second holder 52 is an unsuitable container and the liquid consumption operation is being continued. Therefore, it is possible to restrain a situation where ink remaining at the tip opening section of the ink receiving section 35 is exposed to external air and dried/solidified, a lump of the solidified ink flows into the liquid consumption unit 20 along with ink supplied from a newly mounted second container 52, and a discharge failure of ink occurs.

According to the liquid consumption apparatus 10 of the present embodiment, even when the switching decision to switch the supply source of ink is performed, if the switching destination container 50 is determined to be an unsuitable container, the operation to switch the ink supply source is cancelled. Therefore, it is possible to restrain a situation where an unsuitable container is automatically used by the switching processing even when the switching destination container 50 is the unsuitable container. In the liquid consumption apparatus 10 of the present embodiment, an unspecified container 50 that is not allowed to be used in the liquid consumption apparatus 10 is determined to be an unsuitable container. Therefore, it is possible to restrain a situation where the supply source of ink is switched to an unspecified container 50 and ink that is not assumed to be used in the liquid consumption apparatus 10 begins to be supplied. Thus, it is suppressed that the quality of ink changes from the middle of printing and the print quality is degraded. According to the liquid consumption apparatus 10 of the present embodiment, a container 50 from which the container information CD cannot be normally read is determined to be an unsuitable container. Therefore, it is possible to restrain a situation where a container 50 is set to be the ink supply source by the switching processing while information related to the container 50 is not correctly grasped. According to the liquid consumption apparatus 10 of the present embodiment, a container 50 whose ink remaining amount is not the defined amount or more is determined to be an unsuitable container and the operation to switch the ink supply source to the container 50 is cancelled. Thus, it is possible to restrain a situation where ink shortage easily occurs although the switching of the supply source of ink is performed. When the switching operation is cancelled, if thereafter the switching destination container 50 is replaced to a container 50 whose ink remaining amount is sufficient before the ink in the current ink supply source container 50 runs short, it is possible to avoid interruption of the liquid consumption operation.

According to the liquid consumption apparatus 10 of the present embodiment, when the container 50 is determined to be an unsuitable container, the fact that the container 50 is determined to be an unsuitable container is notified to the user by the error icons EIa and EIb as shown in FIGS. 6A and 6C through the notification unit 15. Therefore, it is possible to restrain a situation where the user does not notice that a standby container 50 that is not the supply source of ink is an unsuitable container. Therefore, it is possible to restrain a situation where the operation to switch the ink supply source is cancelled while the user does not notice that the standby container 50 is an unsuitable container.

According to the liquid consumption apparatus 10 of the present embodiment, when the first container 51 is determined to be an unsuitable container, an ordering screen of a container 50 for replacement is displayed through the notification unit 15 in step S135 of FIG. 5, step S370 of FIG. 8, and step S440 of FIG. 10. Therefore, it is possible to quickly prepare the container 50 for replacement, so that convenience of the user is enhanced.

According to the liquid consumption apparatus 10 of the present embodiment, even when the switching destination container 50 is determined to be an unsuitable container in the switching processing, the user can select whether or not to switch the supply source of ink to the switching destination container 50 in step S630 of the container check processing. Therefore, a user's intention can be reflected in the use of unsuitable container, so that it is possible to enhance convenience of the user of the liquid consumption apparatus 10.

2. Other Embodiments

Various configurations described in the embodiment described above can be changed, for example, as described below. All of the other embodiments described below are regarded as an example of a mode for carrying out the technique of the present disclosure in the same manner as the embodiment described above.

Another Embodiment 1

The liquid consumption apparatus 10 may have a configuration in which a supply source of liquid composition to the liquid consumption unit 20 is switched by the switching mechanism 40 so that not only one of two containers 50 but also one of three containers 50 is switched to the supply source of liquid composition. In this case, the container 50 that is currently the supply source of liquid composition to the liquid consumption unit 20 is defined as the first container 51 and the container 50 to be the next supply source is defined as the second container 52, and then each processing described in the above embodiment may be performed.

Another Embodiment 2

The container 50 is not limited to a cartridge covered by a housing made of resin. The container 50 may be configured as a bag-shaped pack formed of a flexible material or may be configured as a so-called tank. The capacity of the container 50 is not particularly limited. The container 50 may have, for example, a relatively small capacity from several milliliters to several tens of milliliter, or a relatively large capacity from several liters to several tens of liters.

Another Embodiment 3

In the embodiment described above, the switching of the supply source of ink to an unspecified container 50 may be cancelled without inquiring the user whether or not the user will use the unspecified container 50. Further, in the embodiment described above, even when the second container 52 is determined to be an unsuitable container after the switching of the supply source of ink from the first container 51 to the second container 52 is decided in the switching processing, only the result of the determination is notified to the user and the switching of the supply source of ink may be performed without doing anything.

Another Embodiment 4

In the embodiment described above, a determination result that the housing container 50 is determined to be an unsuitable container may be notified to the user by a method other than the error icons EIa and EIb. For example, the determination result may be notified to the user by a warning sound such as a beep sound or audio guidance. Further, in the embodiment described above, a notification of a determination result about suitability of the container 50 by the notification unit 15 may be omitted. In the embodiment described above, the display of the ordering screen through the notification unit 15 may be omitted.

Another Embodiment 5

In the suitability determination that determines whether the container 50 is a suitable container or an unsuitable container, only any one of the use conditions (i) to (iii) described in the above embodiment may be determined. Further, besides the use conditions (i) to (iii), another use condition may be determined. For example, the expiration date of the container 50 may be determined.

Another Embodiment 6

The switching processing in FIG. 8 may be performed when the liquid consumption processing is not performed. For example, execution of the switching processing in FIG. 8 may be started with a case where the user operates the lever provided to the holder 31 as a trigger.

Another Embodiment 7

The liquid consumption apparatus 10 may be configured not only as an ink jet printer but as another type of liquid consumption apparatus. For example, the liquid consumption apparatus 10 may be configured as an adhesion apparatus that applies a liquid adhesive agent as a liquid composition to a medium and consumes the liquid adhesive agent. Alternatively, the liquid consumption apparatus 10 may be configured as a cleaning apparatus that injects liquid detergent as a liquid composition to a medium to be cleaned and consumes the liquid detergent.

3. Form Example

The technique of the present disclosure is not limited to the embodiments and examples described above, but can be implemented in various forms without departing from the scope of the disclosure. For example, the technique of the present disclosure can be implemented in the forms described below. The technical features in each embodiment described above corresponding to the technical features in each form described below can be appropriately replaced and combined in order to solve some or all problems to be solved by the techniques of the present disclosure or in order to achieve some or all objects to be achieved by the present disclosure. The technical features can be appropriately deleted if the technical features are not described to be essential in the present specification.

(1) The first form is provided as a liquid consumption apparatus that receives supply of a liquid composition from a first housing container or a second housing container that houses the liquid composition. The liquid consumption apparatus of this form includes a liquid consumption unit that consumes the liquid composition, a holder having a first mounting port where the first housing container is detachably mounted and a second mounting port where the second housing container is detachably mounted, a switching mechanism that switches a supply source of the liquid composition for the liquid consumption unit to the first housing container or the second housing container, and a control unit that controls operation of the switching mechanism. The control unit performs determination processing that determines whether or not each of the first housing container and the second housing container is an unsuitable container that does not satisfy a predetermined use condition in a period from when the housing container is mounted in the holder to when the housing container is removed from the holder. The control unit performs switching decision that decides switching of the supply source to the second housing container when the first housing container is determined to the unsuitable container while the liquid composition is being supplied from the first housing container to the liquid consumption unit. The control unit continues supply of the liquid composition from the first housing container to the liquid consumption unit regardless of whether or not the second housing container is an unsuitable container until when the switching decision is performed while the liquid composition is being supplied from the first housing container to the liquid consumption unit.

According to the liquid consumption apparatus of this form, the switching decision to switch the supply source of ink to the second housing container is performed when the first housing container is determined to be the unsuitable container while the ink is being supplied from the first housing container. Therefore, it is suppressed that the supply of the liquid composition to the liquid consumption unit is interrupted because the first housing container becomes an unsuitable container. Further, even when the second housing container is determined to be the unsuitable container while the ink is being supplied from the first housing container, the supply of ink from the first housing container is continued, so that it is suppressed that the supply of the liquid composition to the liquid consumption unit is interrupted due to the determination of suitability of the second housing container.

(2) In the liquid consumption apparatus of the form described above, the control unit may perform the switching of the supply source to the second housing container when the second housing container is not determined to be the unsuitable container in a case in which the control unit performs the switching decision.

According to the liquid consumption apparatus of this form, it is possible to cause the second housing container, which is not determined to be the unsuitable container, to continue the supply of the liquid composition to the liquid consumption unit.

(3) In the liquid consumption apparatus of the form described above, the control unit may cancel the switching of the supply source to the second housing container when the second housing container is determined to be the unsuitable container in a case in which the control unit performs the switching decision.

According to the liquid consumption apparatus of this form, it is possible to restrain the liquid composition from being supplied from the second housing container that is determined to be the unsuitable container to the liquid consumption unit.

(4) In the liquid consumption apparatus of the form described above, the control unit may perform the switching of the supply source to the second housing container when the second housing container is not determined to be the unsuitable container and cancel the switching of the supply source to the second housing container when the second housing container is determined to be the unsuitable container in a case in which the control unit performs the switching decision.

According to the liquid consumption apparatus of this form, it is possible to cause the second housing container, which is not determined to be the unsuitable container, to continue the supply of the liquid composition to the liquid consumption unit. Further, it is possible to restrain the liquid composition from being supplied from the second housing container that is determined to be the unsuitable container to the liquid consumption unit.

(5) The liquid consumption apparatus of the form described above may further include a notification unit that notifies a user that the first housing container or the second housing container is determined to be the unsuitable container by the determination processing.

According to the liquid consumption apparatus of this form, it is possible to restrain the user from continuing use of the first housing container or the second housing container while the user does not notice that the housing container is an unsuitable container.

(6) The liquid consumption apparatus of the form (3) described above may further include a notification unit that notifies a user that the second housing container is determined to be the unsuitable container.

According to the liquid consumption apparatus of this form, it is possible to restrain a situation where the switching of the supply source from the first housing container to the second housing container is cancelled while the user does not notice that the second housing container is the unsuitable container.

(7) The liquid consumption apparatus of the form (4) described above may further include a notification unit that notifies a user that the second housing container is determined to be the unsuitable container.

According to the liquid consumption apparatus of this form, it is possible to restrain a situation where the use of the first housing container or the second housing container is continued while the user does not notice that the housing container is the unsuitable container. Further, it is possible to restrain a situation where the switching of the supply source from the first housing container to the second housing container is cancelled while the user does not notice that the second housing container is the unsuitable container.

(8) The liquid consumption apparatus of the form described above may further include a notification unit that notifies a user of a message related to an order of the first housing container when the first housing container is determined to be the unsuitable container.

According to the liquid consumption apparatus of this form, the user can quickly and easily make an order for replacing the unsuitable container, so that convenience of the user is enhanced.

(9) The liquid consumption apparatus of the form described above may further include an operation unit that receives an operation of a user, and in a case in which the control unit performs the switching decision, the control unit may perform the switching of the supply source to the second housing container when the second housing container is not determined to be the unsuitable container, and may perform or cancel the switching of the supply source to the second housing container according to a selection of the user received through the operation unit when the second housing container is determined to be the unsuitable container.

According to the liquid consumption apparatus of this form, even when the second housing container is determined to be the unsuitable container, the use of the second housing container can be continued according to the selection of the user. Therefore, convenience of the user is enhanced.

(10) In the liquid consumption apparatus of the form described above, the control unit may perform the determination processing when the first housing container is mounted in the first mounting port and when the second housing container is mounted in the second mounting port, and when validity of a specification code attached to the first housing container or the second housing container cannot be authenticated in the determination processing, the control unit may determine that the housing container is the unsuitable container.

According to the liquid consumption apparatus of this form, it is possible to restrain a situation where a liquid housing container that is not assumed to be used in the liquid consumption apparatus is mounted and used.

(11) In the liquid consumption apparatus of the form described above, the control unit may perform the determination processing while the liquid consumption unit consumes the liquid composition, determine that the first housing container is the unsuitable container in the determination processing when a housing amount of the liquid composition in the first housing container becomes less than a predetermined defined amount while the liquid composition is being supplied from the first housing container to the liquid consumption unit and perform the switching decision, and perform the switching of the supply source to the second housing container when the second housing container is not determined to be the unsuitable container and cancel the switching of the supply source to the second housing container when the second housing container is determined to be the unsuitable container in a case in which the control unit performs the switching decision.

According to the liquid consumption apparatus of this form, when the housing amount of the liquid composition in the first housing container becomes small, the supply source of the liquid composition is switched to the second housing container, so that it is possible to reduce time and labor for a replacing operation of the liquid housing container by the user. Further, it is possible to restrain the supply source of the liquid composition from being switched to the second housing container that is determined to be the unsuitable container, so that the unsuitable container is restrained from being used.

4. Others

The technique of the present disclosure can be implemented in various forms other than the liquid consumption apparatus. For example, the technique can be implemented in forms such as a control method of a liquid consumption apparatus, a liquid supply apparatus, a control method of a liquid supply apparatus, a liquid consumption system, a determination method of a liquid housing container.

The configuration of the housing container of the present disclosure can be applied to a housing container used for an arbitrary liquid consumption apparatus that consumes liquid other than ink. For example, the configuration can be applied to a liquid container used for various liquid consumption apparatuses as shown below.

Image recording apparatus such as a facsimile apparatus

Color material ejecting apparatus used to manufacture a color filter for an image display apparatus such as a liquid crystal display Electrode material ejecting apparatus used to form electrodes of an organic EL (Electro Luminescence) display, a field emission display (FED), and the like Liquid consumption apparatus that ejects liquid containing bioorganic matter used to manufacture a biochip Sample injection apparatus used as a precision pipette Lubricating oil injection apparatus Resin liquid ejecting apparatus Liquid consumption apparatus that injects lubricating oil to a precision machine such as a watch and a camera in pinpoint accuracy Liquid consumption apparatus that ejects transparent resin solution such as ultraviolet curing resin solution onto a substrate in order to form an optical lens such as a micro-hemispherical lens used for an optical communication element Liquid consumption apparatus that ejects acid or alkaline etching solution in order to etch a substrate or the like Liquid consumption apparatus including a liquid consumption head that discharges a slight amount of other arbitrary droplet The liquid composition housed by the housing container of the present disclosure may be a material whose substance is in a liquid phase. Therefore, the "liquid composition" in the present disclosure includes high-viscosity or low-viscosity liquid-state materials and liquid-state materials such as sol, gel water, other inorganic and organic solvents, solution, liquid resin, and liquid metal (metal melt). Further, the liquid composition includes materials in which particles of functional material composed of solid matter such as pigment or metal particles are dissolved, dispersed, or mixed in a solvent. In addition, as typical examples of the liquid composition, the ink described in the above embodiments, liquid crystal, and the like are given. Here, the "ink" includes various liquid state substances such as general water-based and oil-based inks, a gel ink, and a hot-melt ink.

What is claimed is:

1. A liquid consumption apparatus that receives supply of a liquid composition from a first housing container or a second housing container that houses the liquid composition, the liquid consumption apparatus comprising:

a liquid consumption unit that consumes the liquid composition;

a holder having a first mounting port where the first housing container is detachably mounted and a second mounting port where the second housing container is detachably mounted;

a switching mechanism that switches a supply source of the liquid composition for the liquid consumption unit to the first housing container or the second housing container;

a control unit that controls operation of the switching mechanism; and an operation unit that receives an operation of a user, wherein the control unit performs determination processing that determines whether or not each of the first housing container and the second housing container is an unsuitable container that does not satisfy a predetermined use condition in a period from when the housing container is mounted in the holder to when the housing container is removed from the holder, performs switching decision that decides switching of the supply source to the second housing container when the first housing container is determined to be the unsuitable container while the liquid composition is being supplied from the first housing container to the liquid consumption unit, and continues supply of the liquid composition from the first housing container to the liquid consumption unit regardless of whether or not the second housing container is the unsuitable container until when the switching decision is performed while the liquid composition is being supplied from the first housing container to the liquid consumption unit, and in a case in which the control unit performs the switching decision, the control unit performs the switching of the supply source to the second housing container when the second housing container is not determined to be the unsuitable container, and performs or cancels the switching of the supply source to the second housing container according to a selection of the user received through the operation unit when the second housing container is determined to be the unsuitable container.

2. The liquid consumption apparatus according to claim 1, wherein the control unit performs the switching of the supply source to the second housing container when the second housing container is not determined to be the unsuitable container in a case in which the control unit performs the switching decision.

3. The liquid consumption apparatus according to claim 1, wherein the control unit cancels the switching of the supply source to the second housing container when the second housing container is determined to be the unsuitable container in a case in which the control unit performs the switching decision.

4. The liquid consumption apparatus according to claim 3, further comprising:

a notification unit that notifies a user that the second housing container is determined to be the unsuitable container.

5. The liquid consumption apparatus according to claim 1, further comprising:

a notification unit that notifies a user that the first housing container or the second housing container is determined to be the unsuitable container by the determination processing.

6. The liquid consumption apparatus according to claim 1, wherein the control unit performs the switching of the supply source to the second housing container when the second housing container is not determined to be the unsuitable container and cancels the switching of the supply source to the second housing container when the second housing container is determined to be the unsuitable container in a case in which the control unit performs the switching decision.

7. The liquid consumption apparatus according to claim 6, further comprising:

a notification unit that notifies a user that the second housing container is determined to be the unsuitable container.

8. The liquid consumption apparatus according to claim 1, further comprising:

a notification unit that notifies a user of a message related to an order of the first housing container when the first housing container is determined to be the unsuitable container.

9. The liquid consumption apparatus according to claim 1, wherein the control unit performs the determination processing while the liquid consumption unit consumes the liquid composition, determines that the first housing container is the unsuitable container in the determination processing when a housing amount of the liquid composition in the first housing container becomes less than a predetermined defined amount while the liquid composition is being supplied from the first housing container to the liquid consumption unit and performs the switching decision, and performs the switching of the supply source to the second housing container when the second housing container is not determined to be the unsuitable container and cancels the switching of the supply source to the second housing container when the second housing container is determined to be the unsuitable container in a case in which the control unit performs the switching decision.

10. A liquid consumption apparatus that receives supply of a liquid composition from a first housing container or a second housing container that houses the liquid composition, the liquid consumption apparatus comprising:

a liquid consumption unit that consumes the liquid composition;

a holder having a first mounting port where the first housing container is detachably mounted and a second mounting port where the second housing container is detachably mounted;

a switching mechanism that switches a supply source of the liquid composition for the liquid consumption unit to the first housing container or the second housing container; and a control unit that controls operation of the switching mechanism, wherein the control unit performs determination processing that determines whether or not each of the first housing container and the second housing container is an unsuitable container that does not satisfy a predetermined use condition in a period from when the housing container is mounted in the holder to when the housing container is removed from the holder, performs switching decision that decides switching of the supply source to the second housing container when the first housing container is determined to be the unsuitable container while the liquid composition is being supplied from the first housing container to the liquid consumption unit, and continues supply of the liquid composition from the first housing container to the liquid consumption unit regardless of whether or not the second housing container is the unsuitable container until when the switching decision is performed while the liquid composition is being supplied from the first housing container to the liquid consumption unit, the control unit performs the determination processing when the first housing container is mounted in the first mounting port and when the second housing container is mounted in the second mounting port, and when validity of a specification code attached to the first housing container or the second housing container cannot be authenticated in the determination processing, the control unit determines that the housing container is the unsuitable container.

11. A control method a liquid consumption apparatus that receives supply of a liquid composition from a first housing container or a second housing container that houses the liquid composition by switching the first and the second housing containers as a supply source of the liquid composition to a liquid consumption unit, the control method comprising:

performing determination processing that determines whether or not each of the first housing container and the second housing container is an unsuitable container that does not satisfy a predetermined use condition in a period from when the housing container is mounted in a holder of the liquid consumption apparatus to when the housing container is removed from the holder; and performing switching decision that decides switching of the supply source to the second housing container when the first housing container is determined to be the unsuitable container while the liquid composition is being supplied from the first housing container to the liquid consumption unit, wherein the supply of the liquid composition from the first housing container to the liquid consumption unit is continued regardless of whether or not the second housing container is the unsuitable container until when the switching decision is performed while the liquid composition is being supplied from the first housing container to the liquid consumption unit, and the control method further comprises:

performing the determination processing while the liquid consumption unit consumes the liquid composition, determining that the first housing container is the unsuitable container in the determination processing when a housing amount of the liquid composition in the first housing container becomes less than a predetermined defined amount while the liquid composition is being supplied from the first housing container to the liquid consumption unit and performs the switching decision, and performing the switching of the supply source to the second housing container when the second housing container is not determined to be the unsuitable container and cancels the switching of the supply source to the second housing container when the second housing container is determined to be the unsuitable container in a case in which the switching decision is performed.

* * * * *